US007001009B2

(12) United States Patent
Sakurai

(10) Patent No.: US 7,001,009 B2
(45) Date of Patent: Feb. 21, 2006

(54) RECORDING APPARATUS HAVING WIPING DEVICE

(75) Inventor: Hisaki Sakurai, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/039,338

(22) Filed: Jan. 20, 2005

(65) Prior Publication Data

US 2005/0156996 A1 Jul. 21, 2005

(30) Foreign Application Priority Data

Jan. 20, 2004 (JP) ..... 2004-012086

(51) Int. Cl.
*B41J 2/165* (2006.01)

(52) U.S. Cl. ..... 347/33

(58) Field of Classification Search ..... 347/22, 347/23, 29, 32, 33
See application file for complete search history.

(56) References Cited

U.S. PATENT DOCUMENTS 6,585,351 B1 * 7/2003 Nakagawa et al. ..... 347/33

FOREIGN PATENT DOCUMENTS

JP 07-223321 * 8/1995 ..... 347/33
JP A-8-58102 3/1996

* cited by examiner

*Primary Examiner*—Shih-Wen Hsieh
(74) *Attorney, Agent, or Firm*—Reed Smith LLP

(57) ABSTRACT

A recording apparatus which performs recording by ejecting ink toward a recording medium, the apparatus including: a first and a second nozzle group formed in a nozzle surface so as to be adjacent to each other with a boundary area interposed therebetween, from which are respectively ejected a first ink and a second ink, and each of which consists of a plurality of nozzles; and, a wiping device including a first and a second wiping member which move along the boundary area while being held in abutting contact with the nozzle surface so as to respectively wipe the first ink and the second ink adhering to the nozzle surface. Each of the first and second wiping members is inclined relative to a line perpendicular to a moving direction in which the first and second wiping members move, such that one end of each of the first and the second wiping members located within the boundary area is located frontward of the other end thereof remote from the boundary area, in the moving direction.

39 Claims, 13 Drawing Sheets

RECORDING APPARATUS HAVING WIPING DEVICE

The present application is based on Japanese Patent Application No. 2004-012086 filed on January 20, the contents of which are incorporated herein by reference.

BACKGROUND OF THE INVENTION

1. Field of the Invention

The present invention relates in general to a recording apparatus which performs recording by ejecting, toward a recording medium, mutually different inks respectively from respective nozzle groups.

2. Discussion of Related Art

In a recording apparatus which performs recording by ejecting ink from nozzles, a flushing operation and a purging operation are carried out for maintaining good quality of images to be recorded. In the flushing operation, the ink is ejected to an ink absorption pad for preventing drying of the nozzles. In the purging operation, the ink in which air bubbles and foreign matter are contained is sucked by a suction device, whereby the ink ejection performance is restored. When the purging operation is carried out, the ink which has been sucked from the nozzles may adhere to the nozzle surface. The adhered ink causes the nozzles to be clogged when it is dried, resulting in ink ejection failure. Therefore, the recording apparatus is equipped with a wiping device having a wiping member which wipes the ink adhering to the nozzle surface.

In the recording apparatus, in general, a plurality of inks which are different in color, kind, etc., are used. If the plurality of different inks are wiped by the single wiping member, the inks are mixed with one another. The of different inks, however, causes various undesirable problems described below.

In the recording apparatus arranged to use inks of different colors, for instance, where the inks of the different colors are wiped by the single wiping member, the inks are mixed with each other. If a subsequent wiping operation is carried out with the mixed ink whose color is not originally intended one attaching to and remaining on the wiping member, the mixed ink may enter the nozzles. The mixed ink which has entered the nozzles may be ejected in a subsequent ink ejecting operation.

The recording apparatus is known to use two different kinds of ink, i.e., a dye ink and a pigment ink having respective different characteristics. The dye ink assures good color development and easy tone reproduction of images. The pigment ink does not blur or bleed on plain paper and has high water resistance. If a pigment is used for a black ink, the concentration of the black color can be made high, so that the recorded images become clear or vivid. In view of the above, it is proposed to use the pigment for the black ink and the dye for a yellow ink, a cyan ink, and a magenta ink, for instance.

However, the dye ink and the pigment ink cause aggregation or flocculation reaction upon mixing with each other. For instance, upon the mixing of the pigment ink and the dye ink, the pigment particles in the pigment ink stick to each other or are put together. The sticking of the pigment particles is considered to occur because the negative charge of the pigment particles is cancelled when the positively charged ion present in the dye ink approaches the negatively charged pigment particles. As a result, the dispersed state of the pigment particles is broken. The sticking of the pigment particles is also considered to occur because the dispersed state of the pigment particles is broken due to entering of the solvent as one composition of the dye ink into the pigment ink.

In the recording apparatus arranged to use the dye ink and the pigment ink, therefore, where those different kinds of inks are wiped by the single wiping member, the dye ink and the pigment ink are mixed with each other, resulting in the aggregation reaction. In this case, the nozzles may be clogged with the mixed ink suffering from the aggregation reaction, undesirably causing the ink ejection failure.

The mixing of the inks may further cause solvent solidification, an increase in the viscosity, and so on.

Accordingly, to avoid the miring of the inks, there has been proposed a wiping device having wiping members arranged to respectively wipe the different inks.

One example of such a wiping device will be explained by referring to FIGS. 9–11. FIG. 9 shows relative positional relationship between nozzle rows of a recording head and wiping members in a recording apparatus which has such a wiping device. FIG. 10A is a plan view showing a state in which inks adhere to a nozzle surface and FIG. 10B is a front view of the plan view of FIG. 10A. FIG. 11A is a plan view showing a state in which the wiping members wipe the respective inks and FIG. 11B is a front view of the plan view of FIG. 11A.

The recording apparatus has a recording head comprising a black-ink recording head 300 and a yellow-ink recording head 400 which are adjacent to each other. (The black-ink recording head 300 and the yellow-ink recording head 400 may be hereinafter referred to as "the black-ink head 300" and "the yellow-ink head 400", respectively.) The black-ink head 300 and the yellow-ink head 400 are arranged to perform recording with a black ink 302 and a yellow ink 402, respectively. The recording apparatus has a nozzle surface which includes a black-ink nozzle surface 303 and a yellow-ink nozzle surface 408 which are adjacent to and flush with each other. (The black-ink nozzle surface 303 and the yellow-ink nozzle surface 403 may be hereinafter simply referred to as "the nozzle surface 303" and "the nozzle surface 403", respectively.) As shown in FIG. 9, a plurality of black-ink nozzles 301 for ejecting the black ink 302 are formed in rows in the nozzle surface 303 so as to be spaced apart from each other at a predetermined spacing pitch while a plurality of yellow-ink nozzles 401 are formed in rows in the nozzle surface 408 at a predetermined spacing pitch. Namely, a nozzle group consisting of the plurality of black-ink nozzles 301 and a nozzle group consisting of the plurality of yellow-ink nozzles 401 are arranged adjacent to each other such that the rows of the nozzles of the adjacent nozzle groups are parallel to each other.

As shown in FIGS. 10A and 10B, the black ink 302 adheres to the nozzle surface 303 and the yellow ink 402 adheres to the nozzle surface 403. The wiping device includes two wiper blades 200, 201 each provided by an elastic member formed of rubber, for instance. The wiper blades 200, 201 are elongate plates and respectively have wiping surfaces 200*a*, 201*a* by which the respective inks are wiped. The wiper blades 200, 201 are positioned such that the wiping surfaces 200*a*, 210*a* intersect, at right angles, a moving direction (indicated by arrows F7 in FIG. 10A) in which the wiper blades 200, 201 move. When the recording head stops at a predetermined wiping position, the wiping device operates such that the wiper blades 200, 201 move on the respective nozzle surfaces 303, 403 in the moving direction (F7) while being held in contact with the same 303, 403. As the wiper blades 200, 201 move as described above, the wiper blade 200 wipes the black ink 302 adhering to the nozzle surface 303 and the wiper blade 201 wipes the yellow ink 402 adhering to the nozzle surface 403, as shown in FIG. 11A. The recording apparatus equipped with the wiping device described above is disclosed in JP-A-8-58102, for instance.

SUMMARY OF THE INVENTION

Even where the different inks are wiped by the respective wiper blades as described above, the inks remaining on the respective wiping surfaces 200*a*, 201*a* overflow adjacent one ends of the respective wiper blades 200, 201 into an area interposed between the two nozzle groups (i.e., a non-wipe area) and remain in the area, as indicated in an encircled portion M in FIG. 11A. Accordingly, a larger amount of the ink remain in the non-wipe area, as compared with the amount of the ink attaching to the nozzle surface in the purging operation. If the two different inks which have been wiped by the wiper blades and which have overflowed into the non-wipe area are mixed with each other, there arises a problem of the above-described aggregation reaction, for instance. Since the mixed ink suffering from the aggregation reaction exists in the non-wipe area, the mixed ink cannot be wiped away by the wiper blades in a subsequent wiping operation. Moreover, as the wiping operation is repeatedly carried out, the aggregation reaction also repeatedly occurs, so that the thickness of the mixed ink remaining on the nozzle surface without being wiped becomes large. In this instance, when the nozzle surfaces for the respective inks are covered with a cap, there may arise the following problem: When the nozzle surface 303 is covered with a cap 600, for instance, a clearance indicated by K in FIG. 12 is generated between the nozzle surface 303 and the cap 500 due to the portion G (FIG. 12) of the mixed ink suffering from the aggregation reaction. Since the clearance K is present between the nozzle surface 303 and the cap 500, the nozzles cannot be air-tightly sealed by the cap 500, resulting in drying of the nozzles. The drying of the nozzles undesirably causes ink ejection failure, so that the quality of the recorded images is deteriorated. In addition to the problem of the aggregation reaction, the mixing of the different inks may cause various problems described above.

It is therefore an object of the present invention to provide a recording apparatus arranged to perform recording by ejecting, toward a recording medium, mutually different inks respectively from respective nozzle groups, which apparatus is free from various problems arising from the mixing of different inks and assures high quality of images to be recorded.

The object indicated above may be achieved according to a first aspect of the present invention, which provides a recording apparatus which performs recording by ejecting ink toward a recording medium, the apparatus comprising; a first nozzle group and a second nozzle group which are formed in a nozzle surface so as to be adjacent to each other with a boundary area interposed therebetween, from which are respectively ejected a first ink and a second ink, and each of which consists of a plurality of nozzles; and a wiping device including a first wiping member and a second wiping member which move along the boundary area while being held in abutting contact with the nozzle surface so as to respectively wipe the first ink and the second ink adhering to the nozzle surface. Each of the first wiping member and the second wiping member is inclined relative to a line perpendicular to a moving direction in which the first and second wiping members move, such that one end of each of the first and the second wiping members located within the boundary area is located frontward of the other end thereof remote from the boundary area, in the moving direction.

In the recording apparatus constructed according to the above-indicated first aspect of the invention, the first and second inks which have been wiped by the respective first and second wiping members flow in respective opposite directions away from the boundary area and toward the respectively other ends remote from the boundary area, along the respective first and second wiping members. Accordingly, the first ink which has been wiped by the first wiping member does not flow toward the second nozzle group beyond the one end of the first wiping member located within the boundary area, and the second ink which has been wiped by the second wiping member does not flow toward the first nozzle group beyond the one end of the second wiping member located within the boundary area. According to the present arrangement, the first ink and the second ink which have been wiped are less likely to mix with each other. Therefore, the present apparatus does not suffer from various drawbacks which would be otherwise caused by the mixing of the two inks such as the problem of aggregation reaction described above, and assures high quality of images to be recorded. The first and second wiping members configured according to the above-described first aspect of the invention correspond to means which realizes the respective flows of the first and the second inks that have been wiped by the respective first and second wiping members to flow in respective directions away from the boundary area and opposite to each other.

The object indicated above may also be achieved according to a second aspect of the present invention, which provides a recording apparatus which performs recording by ejecting ink toward a recording medium, the apparatus comprising: a first nozzle group and a second nozzle group which are formed in a nozzle surface so as to be adjacent to each other with a boundary area interposed therebetween, from which are respectively ejected a first ink and a second ink, and each of which consists of a plurality of nozzles; and a wiping device including a first wiping member and a second wiping member which move along the boundary area while being held in abutting contact with the nozzle surface so as to respectively wipe the first ink and the second ink adhering to the nozzle surface. At least one of the first wiping member and the second wiping member has an extension part which is formed at one end thereof located within the boundary area and which extends in a moving direction in which the first and second wiping members move.

In the recording apparatus constructed according to the above-indicated second aspect of the invention, owing to provision of the extension part which is formed at the one end of the at least one of the first and second wiping members that is located within the boundary area and which extends in the moving direction of the first and second wiping members, at least one of the first and second inks which has been wiped by the at least one of the first and second wiping members that is provided with the extension part is prevented from flowing into the boundary area beyond the one end thereof. Namely, the risk of flowing of the ink into the boundary area is lower in the present arrangement, as compared with an arrangement in which wiping members are not provided with any extension part. Therefore, the present arrangement is effective to prevent mixing of the first and second inks which have been wiped by the respective first and second wiping members, avoiding various problems such as the aggregation reaction which would be otherwise caused by the mixing of the inks. Thus, the present recording apparatus is capable of recording images with high quality. For preventing the mixing of the inks with higher reliability, it is preferable that the first and second wiping members have the respective extension parts.

In the recording apparatus constructed according to the above-indicated second aspect, the first wiping member and the second wiping member may have, at the respective one ends thereof located within the boundary area, the extension part which is common to the first wiping member and the second wiping member.

Where the first and second wiping members have the extension part which is common to the first and second wiping members and which is formed at the respective one ends thereof located within the boundary area, a region in the boundary area which is occupied by the extension part is made smaller, as compared with an arrangement in which the first and second wiping members have the extension parts, respectively. Where the first and second wiping members have the respective extension parts, a region between the respective extension parts of the two wiping members is a non-wipe area that cannot be wiped by the two wiping members. However, the present arrangement in which the first and second wiping members have the common extension part eliminates such a non-wipe area, permitting the first and second wiping members to wipe larger amounts of the first and the second inks. Accordingly, the risk of mixing of the first and second inks is reduced, so as to reduce various problems which would arise from the mixing of the inks such as the aggregation reaction.

The object indicated above may also be achieved according to a third aspect of the present invention, which provides a recording apparatus which performs recording by ejecting ink toward a recording medium, the apparatus comprising: a first nozzle group and a second nozzle group which are formed in a nozzle surface so as to be adjacent to each other with a boundary area interposed therebetween, from which are respectively ejected a first ink and a second ink, and each of which consists of a plurality of nozzles; and a wiping device including a first wiping member and a second wiping member which move along the boundary area while being held in abutting contact with the nozzle surface so as to respectively wipe the first ink and the second ink adhering to the nozzle surface. The wiping device further includes ink-flow restricting means for restricting a flow of the first ink which has been wiped by the first wiping member and a flow of the second ink which has been wiped by the second wiping member, such that the flow of the first ink does not flow toward the second nozzle group beyond one end of the first wiping member located within the boundary area and the flow of the second ink does not flow toward the first nozzle group beyond one end of the second wiping member located within the boundary area.

In the recording apparatus constructed according to the above-indicated third aspect of the invention, the ink-flow restricting means restricts the flow of the wiped first ink so as not to flow toward the second nozzle group beyond the one end of the first wiping member and the flow of the wiped second ink so as not to flow toward the first nozzle group beyond the one end of the second wiping member, whereby the wiped inks do not remain in the boundary area. Accordingly, the risk of mixing of the two inks is low in the present arrangement, to thereby avoid various drawbacks such as the aggregation reaction which would be otherwise caused by the mixing of the two inks. Hence, the present apparatus assures high quality of images to be recorded.

As one example of the ink-flow restricting means described above, each of the first wiping member and the second wiping member may be configured so as to be inclined relative to a line perpendicular to a moving direction in which the first and second wiping members move, such that one end of each of the first wiping member and the second wiping member located within the boundary area is located frontward of the other end thereof remote from the boundary area, in the moving direction.

As another example of the ink-flow restricting means described above, at least one of the first wiping member and the second wiping member may be configured so as to have an extension part which is formed at one end thereof located within the boundary area and which extends in a moving direction in which the first and second wiping members move.

In the recording apparatus constructed according to any of the first through third aspects of the present invention, the one ends of the respective first and second wiping members may be located within the boundary area such that a spacing distance between the one ends as measured in a direction perpendicular to the moving direction of the two wiping members is minimized. In a case where the spacing distance between the one ends as measured in that direction is relatively large, the non-wipe area which cannot be wiped by the wiping members is inevitably formed between the one ends. According to the present arrangement, however, such a non-wipe area can be made small so that larger amounts of the inks can be wiped by the wiping members. Accordingly, the risk of mixing of the two inks is low in the present arrangement, to thereby avoid various drawbacks such as the aggregation reaction which would be otherwise caused by the mixing of the two inks. As one example of the present arrangement, the one end of the first wiping member is located at a position in the direction perpendicular to the moving direction, which position is not nearer to the first nozzle group than a position at which the one end of the second wiping member is located in the direction. Described more specifically, the one end of the first wiping member and the one end of the second wiping member may be in contact with each other or may be integrated with each other.

In the recording apparatus constructed according to any of the first through third aspects of the present invention, the plurality of nozzles of each of the first nozzle group and the second nozzle group may be arranged in the moving direction.

Where the nozzles of each nozzle group are arranged in the moving direction, the relative positional relationship between each wiping member and any of nozzles in wiping any of nozzles by the wiping member is substantially constant. Accordingly, a load which acts on the wiping member upon wiping the ink is substantially constant irrespective of which nozzles the wiping member wipes. This arrangement makes it easy to prevent each ink from flowing into the boundary area, thereby reducing the risk of flowing of the ink into the boundary area. Therefore, the present arrangement is less likely to suffer from the mixing of the inks, avoiding various drawbacks such as the aggregation reaction which would arise from the mixing of the inks.

In the recording apparatus constructed according to any of the first through third aspects of the present invention, the first ink ejected from the first nozzle group may be a pigment ink and the second ink ejected from the second nozzle group may be a dye ink. When the pigment ink and the dye ink are mixed with each other, various problems are caused such as the aggregation reaction explained above. In this respect, where the first nozzle group is arranged to eject the pigment ink and the second nozzle group is arranged to eject the dye ink in the recording apparatus constructed according to any of the first through third aspects of the invention, it is possible to prevent the mixing of the different inks respectively ejected from the first and second nozzle groups, thereby avoiding various problems described above which arise from the mixing of the inks, such as the aggregation reaction.

In the recording apparatus constructed according to any of the first through third aspects of the present invention, the first ink ejected from the first nozzle group may be a black ink and the second ink ejected from the second nozzle group may be an ink other than the black ink. As described above, where the pigment is used for the black ink, the concentration of the black color can be made high, so that the recorded images become clear or vivid. Accordingly, in general, the pigment is used for the black ink and the dye is used for the inks other than the black ink. In this respect, where the first nozzle group is arranged to eject the black ink and the second nozzle group is arranged to eject the ink other than the black ink in the recording apparatus constructed according to any of the first through third aspects of the invention, the mixing of the different inks respectively ejected from the first and second nozzle groups can be effectively prevented, so as to avoid various problems described above which arise from the mixing of the inks, such as the aggregation reaction.

Moreover, where the black ink is mixed with one of a plurality of inks other than the black ink (e.g., a cyan ink, a yellow ink, and a magenta ink), the color of the mixed ink is largely influenced by the black ink, as compared with a case where any two of the plurality of inks other than the black ink are mixed with each other. In an arrangement wherein a nozzle group which ejects the black ink and a nozzle group which ejects an ink other than the black ink are located adjacent to each other, the black ink and the ink other than the black ink may mix with each other and enter nozzles during the wiping operation. In this case, the mixed ink which has entered the nozzles and whose color is largely influenced by the black ink may be ejected in a subsequent ink ejecting operation, resulting in a deterioration of the quality of images to be recorded on the recording medium. Where the first nozzle group is arranged to eject the black ink and the second nozzle group is arranged to eject the ink other than the black ink in the recording apparatus constructed according to any of the first through third aspects of the invention, it is possible to prevent mixing of the black ink which has been wiped by the fist wiping member and the ink which is other than the black ink and which has been wiped by the second wiping member, so that the deterioration of the recorded image can be avoided. It is noted that the color of the yellow ink is largely influenced by the black ink. In view of this, this arrangement is advantageous when applied to any of the first through third aspects of the invention described above.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

<1st Embodiment>

There will be described a first embodiment of the present invention.

[Principal Structure of Recording Apparatus]

Figure 1:
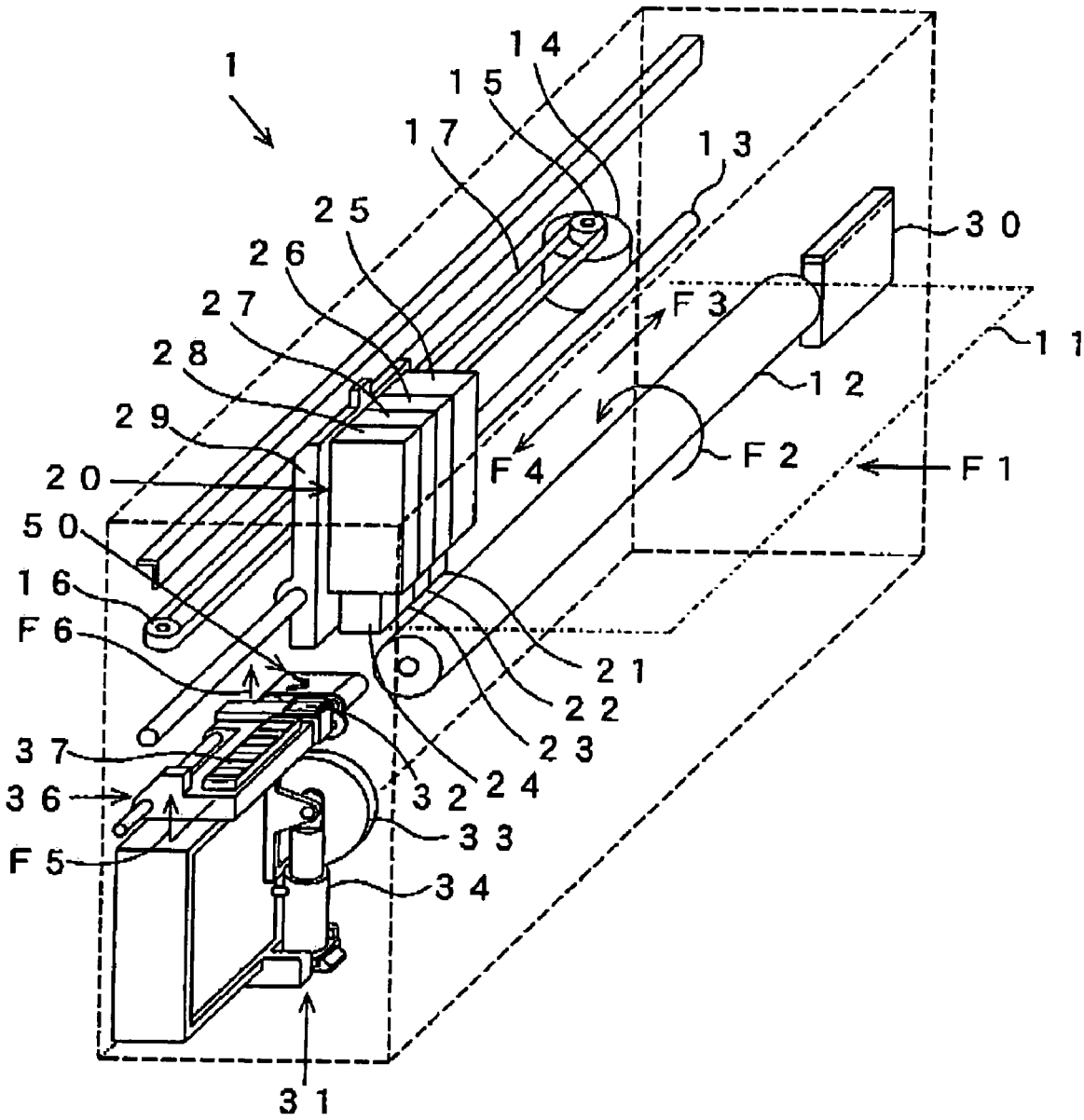
FIG. 1 is a perspective view showing a principal part of an inner structure of a recording apparatus to which the present invention is applied.
Figure 2A:
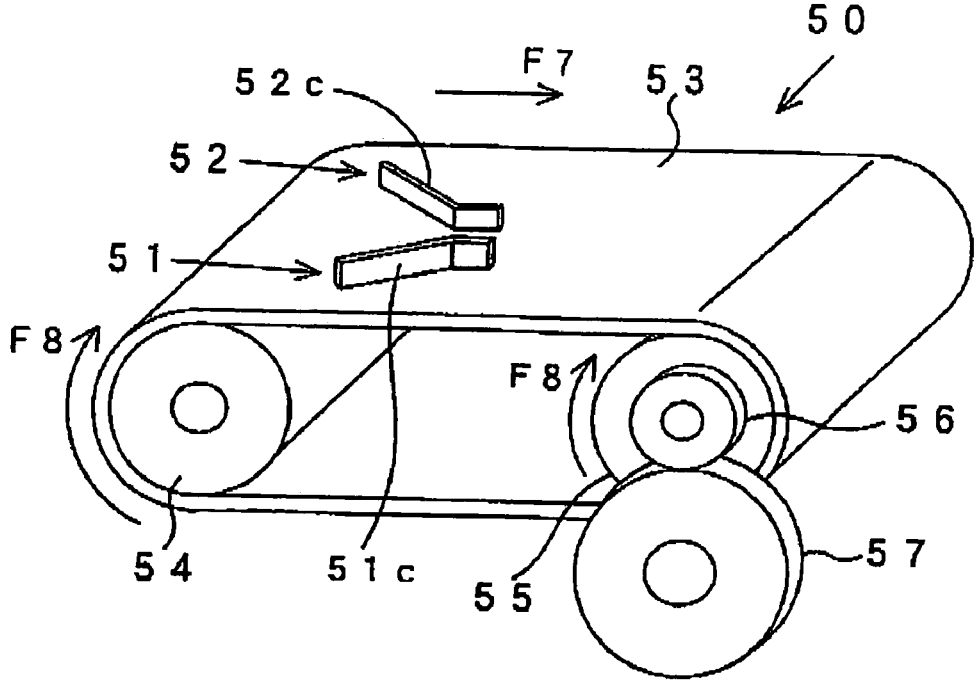
FIG. 2A is a view showing a principal structure of a wiping device which is installed on the recording apparatus of FIG. 1 and which is constructed according to a first embodiment.

There will be first explained a principal structure of a recording apparatus to which the principle of the present invention is applied. FIG. 1 is a perspective view showing a principal part of an inner structure of the recording apparatus generally indicated at 1. FIG. 2A is a view showing a principal structure of a wiping device which is installed on the recording apparatus 1. FIG. 21B is a plan view showing wiper blades of the wiping device of FIG. 2A. FIG. 2C is a front view of the plan view of FIG. 2B. FIG. 3 is a view showing relative positional relationship between the wiper blades and the rows of nozzles.

The recording apparatus 1 shown in FIG. 1 includes a platen roller 12 for feeding a recording sheet 11 fed from a direction indicated by an arrow F1 toward a direction indicated by an arrow F2. In the vicinity of the platen roller 12, a carriage shaft 13 is disposed so as to be in parallel with the rotation axis of the platen roller 12. A carriage 29 on which a recording head 20 is mounted is supported on the carriage shaft 13 such that the carriage shaft 18 is inserted through the lower end portion of the carriage 29. A carriage motor 14 is disposed near one end of the carriage shaft 13 and a pulley 16 is disposed near the other end of the same 13. Another pulley 15 is attached to the rotation axis of the carriage motor 14. Between the two pulleys 15, 16, an endless belt 17 is stretched.

The carriage 29 is fixed at its upper end portion to the endless belt 17 so that the carriage 29 is reciprocably moved in directions indicated by arrows F3 and F4 along the carriage shaft 13 by driving the carriage motor 14. The recording head 20 includes a black ink head 21 for ejecting a black ink, a yellow ink head 22 for ejecting a yellow ink, a cyan ink head 23 for ejecting a cyan ink, and a magenta ink head 24 for ejecting a magenta ink. For the respective heads 21–24, there are provided ink cartridges 25–28 for supplying the respective inks to the respective heads 21–24. The heads 21–24 face downwards so as to be opposed to the circumferential surface of the platen roller 12 and eject the respective inks in a downward direction toward the recording sheet 11 held on the circumferential surface of the platen roller 12.

In the vicinity of one end of the platen roller 12, there is disposed an ink absorption pad 30 at a position outside a recording region on the recording sheet 11. The ink absorption pad 30 which is formed of a porous material is for absorbing the inks ejected from the heads 21–24 when a flushing operation is carried out for restoring the ink ejection performance of the heads 21–24 by discharging poor-quality inks from the nozzles. In the vicinity of the other end of the platen roller 12, there is disposed a purging device 31 at a position outside the recording region on the recording sheet 11. The purging device 31 carries out a purging operation for restoring the ink ejection performance by sucking the poor-quality inks and air bubbles contained in the inks from the nozzles of the heads 21–24. The purging device 31 includes a suction cap 32 which covers a nozzle surface of each recording head 21–24 in which a plurality of nozzles are formed, a cam 33 which moves the suction cap 82 in a direction indicated by an arrow F6, and a pump 34 which generates a negative pressure in the suction cap 32.

On one side of the suction cap 32 remote from the platen roller 12, there is disposed a capping device 36 having a cap 37 for covering the nozzle surface of the heads 21–24 of the recording head 20 when the recording head 20 returns to its home position, so as to prevent the inks in the heads 21–24 from drying at the nozzles. On another side of the suction cap 32 nearer to the platen roller 12, there is disposed a wiping device 50 which wipes the inks and the foreign matter adhering to the nozzle surface of the heads 21–24.

[Principal Structure of Wiping Device 50]

In the following description, each of directions (indicated by arrows F9) from an intermediate boundary area E in FIG. 3 (which will be described) toward respective two nozzle groups 21*g*, 22*g* which are adjacent to each other with the boundary area E interposed therebetween (the two nozzle groups 21*g*, 22*g* will be described) is referred to as "an outward direction" while each of directions from the respective two nozzle groups 21*g*, 22*g* toward the intermediate boundary area E is referred to as "an inward direction". A direction (indicated by arrows F7) in which the first and second wiper blades 51, 52 of the wiping device 50 (which will be described) move is referred to as "a frontward direction" while a direction opposite to the frontward direction is referred to as "a backward direction".

As shown in FIG. 2A, the wiping device 50 includes: a pair of rotation rollers 54, 65; an endless belt 53 stretched between the rollers 54, 55: the first and second wiper blades 51, 52 provided on the endless belt 53 and functioning as a first wiping member and a second wiping member, respectively; a gear 56 fixed to the rotation axis of the roller 55; and a gear 57 meshing the gear 56. The gear 57 is connected to a drive mechanism (not shown), such as a drive mechanism for driving the purging device 31.

Figure 2B:
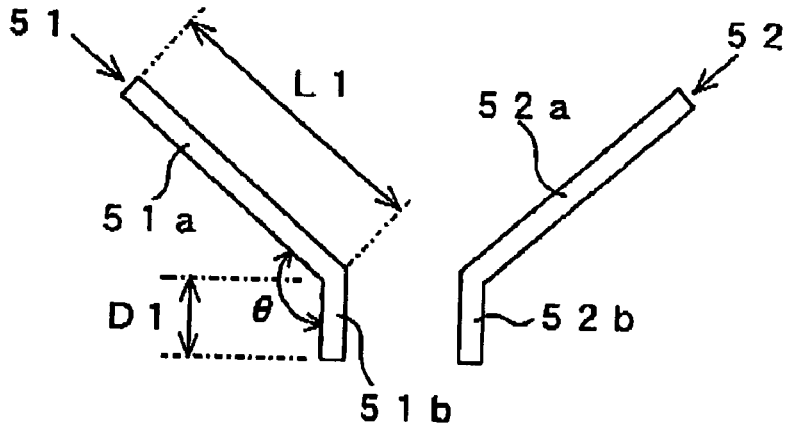
FIG. 2B is a plan view showing per blades of the wiping device of FIG. 2A.
Figure 2C:
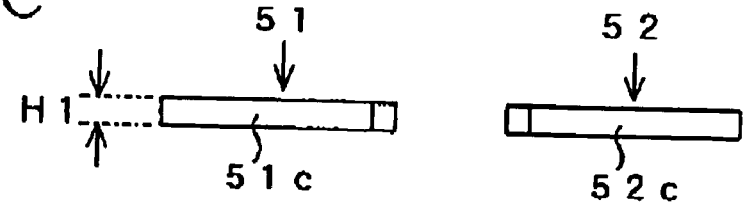
FIG. 2C is a front view of the plan view of FIG. 2B.
Figure 3:
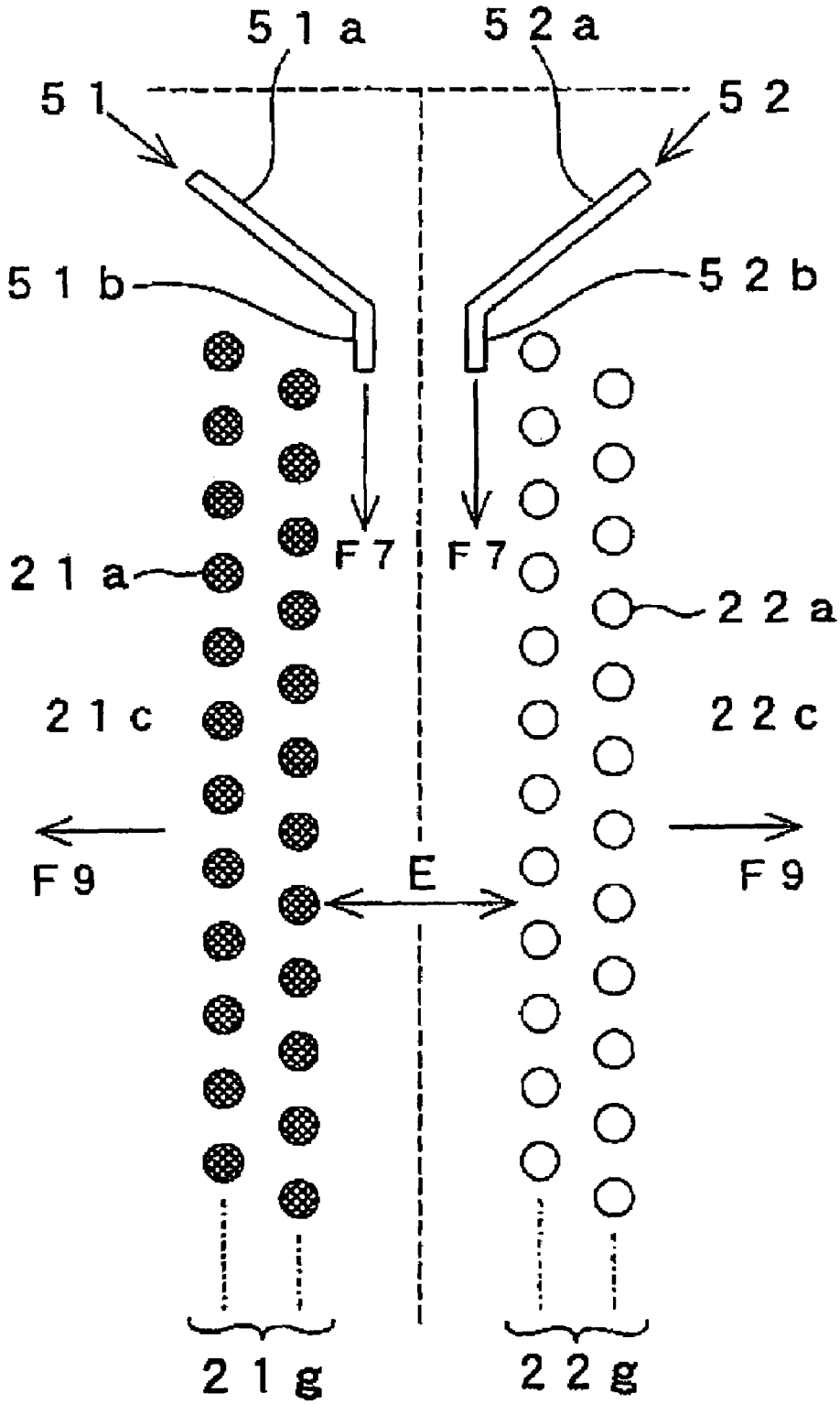
FIG. 3 is a view showing relative positional relationship between the wiper blades and the rows of nozzles.

As shown in FIG. 2B, the first wiper blade 51 has a main part 51*a* and an extension part 51*b* which extends from one end of the main part 51*a* that is located frontward of the other end in the moving direction of the two wiper blades 51, 52. Strictly speaking, the extension part 51*b* extends along a line which is parallel to the moving direction. Similarly, the second wiper blade 62 has a main part 52*a* and an extension part 62*b* which extends from one end of the main part 52*a* that is located frontward of the other end in the moving direction. Strictly speaking, the extension part 52*b* extends along a line which is parallel to the moving direction. Hereinafter, the above-indicated one ends of the main parts 51*a*, 52*a* of the respective first and second wiper blades 51, 52 are referred to as "front ends" while the other ends of the main parts 51*a*, 52*a* are referred to as "rear ends".

The two wiper blades 51, 52 are provided on the endless belt 53 so as to be symmetrical relative to a straight line which passes a mid point between the two wiper blades 61, 62 as measured in the direction perpendicular to the moving direction and which is parallel to the moving direction of the wiper blades 51, 52. Each of the main parts 51*a*, 52*a* of the respective wiper blades 51, 52 is an elongate plate having a small thickness while each of the extension parts 51*b*, 52*b* is a plate having the same thickness as the main parts 51*a*, 52*a*. One of opposite surfaces of each main part 51*a*, 52*a* which is located frontward of the other surface in the moving direction (indicated by the arrow F7 in FIG. 2A), i.e., a front surface of each main part 51*a*, 52*a*, functions as a wiping surface 51*c*, 52*c*. One of opposite surfaces of each extension part 51*b*, 52*b* which is to be located nearer to the nozzles during the wiping operation has a function of preventing the inks which have been wiped by the main parts 51*a*, 52*a* from flowing into the boundary area E (FIG. 3) interposed between the adjacent two nozzle groups.

In the present embodiment, each of the first and second wiper blades 51, 52 is formed of an elastic material such as rubber. For instance, the first and second wiper blades 51, 52 are formed of EPDM (ethylene-propylene-diene-rubber).

As shown in FIG. 3, in the present embodiment, the explanation will be made with respect to a case where the two nozzle groups which are adjacent to each other with the boundary area E interposed therebetween is a black-ink nozzle group 21*g* of the black-ink head 21 from which the black ink is ejected and a yellow-ink nozzle group 22*g* of the yellow-ink head 22 from which the yellow ink is ejected. The black-ink nozzle group 21*g* consists of a plurality of black-ink nozzles 21*a* and is formed in a black-ink nozzle surface 21*c*. The yellow-ink nozzle group 22*g* consists of a plurality of yellow-ink nozzles 22*a* and is formed in a yellow-ink nozzle surface 22*c*. The black-ink nozzle group 21*g* corresponds to a first nozzle group from which is ejected a first ink in the form of the black ink and the yellow-ink nozzle group 22*g* corresponds to a second nozzle group form which is ejected a second ink in the form of the yellow ink. As described above, between the two nozzle groups 21*g*, 22*g*, the boundary area E in which no nozzles are formed is present. The black-ink nozzle surface 21*c* and the yellow-ink nozzle surface 22*c* are flush with each other so as to constitute a nozzle surface. (Hereinafter, the black-ink nozzle surface 21*c* and the yellow-ink nozzle surface 22*c* may be referred to simply as "the nozzle surface 21*c*" and "the nozzle surface 22*c*", respectively, and the nozzle surfaces 21*c*, 22*c* cooperate to provide the nozzle surface.)

Where one of areas which is located on one of opposite sides of the boundary area E and on which the black-ink nozzle group 21*g* is present is referred to as "a first outer area", and the other of the areas which is located on the other side and on which the yellow-ink nozzle group 22*g* is present is referred to as "a second outer area", the main part 51*a* of the first wiper blade 51 obliquely extends from the first outer area toward the boundary area E such that the front end of the main part 51*a* is located ahead of the rear end thereof in the frontward direction (indicated by the arrows F7 in FIG. 3) in which the two wiper blades 51, 52 move during the wiping operation, and the extension part 51*b* of the first wiper blade 51 extends from the front end of the main part 51*a* in the moving direction. The main part 52*a* of the second wiper blade 52 obliquely extends from the second outer area toward the boundary area E such that the front end of the main part 52*a* is located ahead of the rear end thereof in the frontward direction, and the extension part 52*b* of the second wiper blade 52 extends from the front end of the main part 52*a* in the moving direction. In other words, each of the main parts 51*a*, 52*a* is inclined relative to a line perpendicular to the moving direction in which the two wiper blades 51, 52 move, such that one end of each of the main parts 51*a*, 52*a* located within the boundary area E is located frontward of the other end remote from the boundary area E, in the moving direction.

The rear end of the main part 51*a* of the first wiper blade 51 is located outwardly of the outermost row of the black-ink nozzles 21*a* while the front end of the main part 51*a* is located inwardly of the innermost row of the black-ink nozzles 21*a* and is located within the boundary area E, and the extension part 51*b* is located within the boundary area E. Similarly, the rear end of the main part 52*a* of the second wiper blade 52 is located outwardly of the outermost row of the yellow-ink nozzles 22*a* while the front end of the main part 52*a* is located inwardly of the innermost row of the yellow-ink nozzles 22*a* and is located within the boundary area E, and the extension part 52*b* is located within the boundary area E. In other words, each of the main parts 51*a*, 52*a* is arranged so as to be obliquely located on the nozzle surface such that the front end of each main part 51*a*, 52*a* is located ahead of the rear end in the frontward or moving direction. That is, the main parts 51*a*, 52*a* are arranged such that a distance therebetween as measured in a direction perpendicular to the moving direction gradually decreases in the moving direction.

As shown in FIG. 3, the first wiper blade 51 is arranged to be located relative to the nozzle surface 21*c* so as to satisfy conditions that, when the first wiper blade 51 moves from one of longitudinally opposite ends of the nozzle surface 21*c* to the other of the longitudinally opposite ends, the main part 51*a* passes all of the black-ink nozzles 21 while the extension part 51*b* passes the boundary area E without passing the black-ink nozzles 21*a*. Similarly, the second wiper blade 52 is arranged to be located relative to the nozzle surface 22*c* so as to satisfy conditions that, when the second wiper blade 52 moves from one of longitudinally opposite ends of the nozzle surface 22*c* to the other of the longitudinally opposite ends, the main part 52*a* passes all of the yellow-ink nozzles 22*a* while the extension part 52*b* passes the boundary area E without passing the yellow-ink nozzles 22*a*.

The length L1 (FIG. 23) of each main part 51*a*, 52*a* and the angle θ (FIG. 2B) defined or formed by and between each main part 51*a*, 52*a* and the moving direction (the angle θ defined or formed by and between each main part 51*a*, 52*a* and each extension part 61*b*, 52*b* in the present embodiment wherein the extension parts 51*b*, 52*b* extends in parallel with the moving direction) are determined so as to satisfy the above-described conditions. Where the angle θ is too small the inks which have been wiped by the respective first and second wiper blades 51, 52 tend to remain on the wiping surfaces 51, 52*c*, so that the wiped inks are not likely to flow in respective outward directions away from the boundary area E and opposite to each other (i.e., in the directions indicated by arrows F9 in FIG. 3). In view of this, where the direction of extension of the extension parts 51*a*, 52*a* is the same as the moving direction of the two wiper blades 51, 52, the angle θ is preferably not smaller than 90 degrees although the angle θ is not particularly limited. Where the angle θ is increased, however, it is needed to increase the length L1 of the main part 51*a*, 52*a* for permitting the main part 51*a*, 52*a* to pass all of the corresponding nozzles 21*a*, 22*a* so as to wipe the inks with the respective wiping surface 51*c*, 52*c*. The increase in the length L1 of the main part 51*a*, 52*a* leads to an increase in the overall length of the endless belt 53, resulting in an undesirable increase in the size of the wiping device 50. In this case, the recording apparatus inevitably tends to be large-sized. Accordingly, the angle θ is preferably around 135 degrees.

[Principal Structure of Control System of Recording Apparatus]

Referring next to a block diagram of FIG. 4, there will be explained a principal structure of a control system of the recording apparatus 1.

Figure 4:
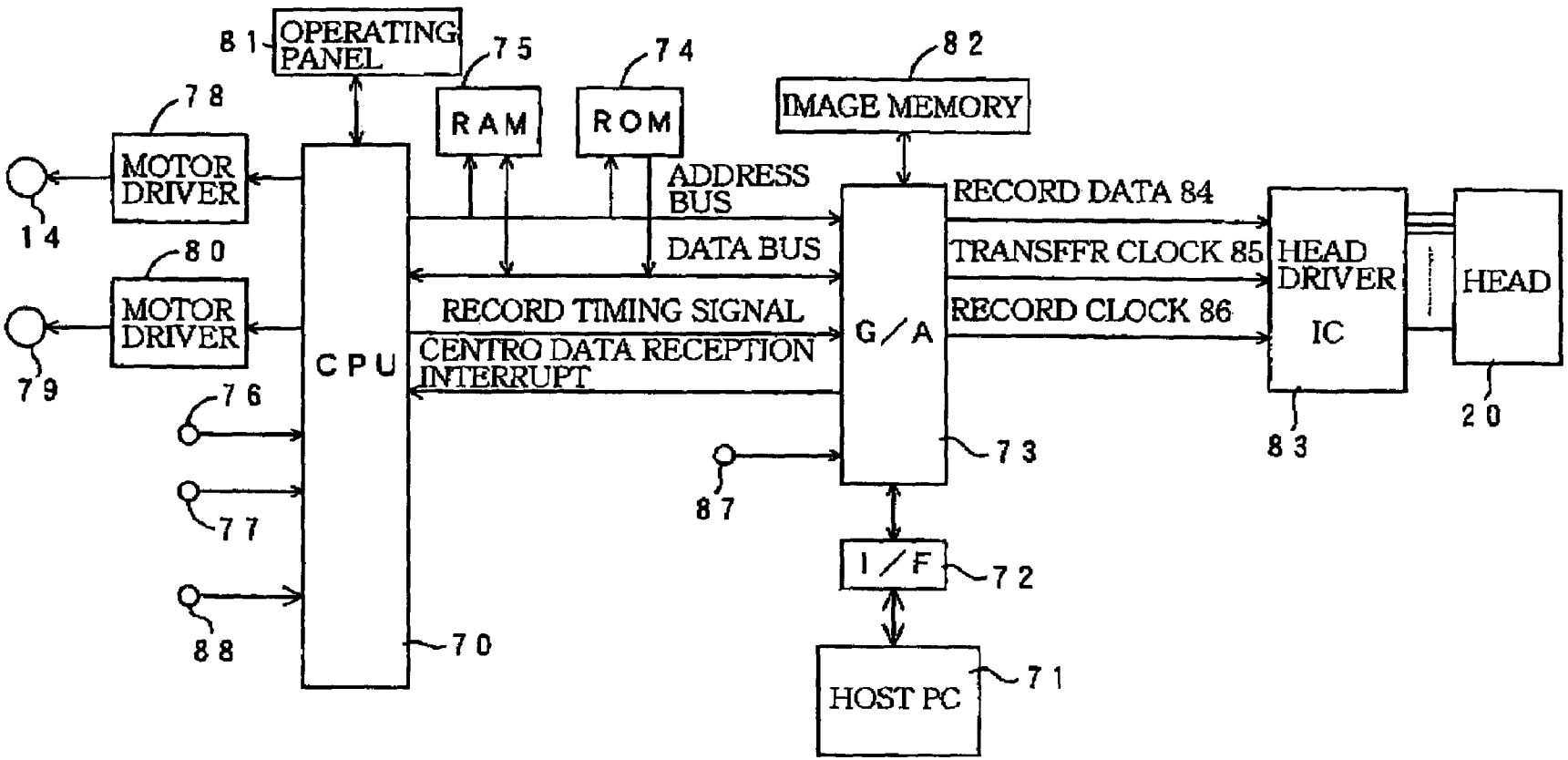
FIG. 4 is a block diagram showing a principal structure of a control system of the recording apparatus of FIG. 1.

As shown in FIG. 4, the recording apparatus 1 includes a CPU 70 which controls the recording head 20 to perform recording and which controls various devices described above, and a gate array (G/A) 73 which receives, through an interface (I/F) 72, record data transmitted from a host computer (host PC) 71 and performs control of development of the record data. To address bus and data bus connecting the CPU 70 and the gate array 73, there are connected a ROM 74 and a RAM 75. The ROM 74 stores operation programs executed by the CPU 70 while the RAM 75 temporarily stores the data received by the gate array 73. The CPU 70 performs inputting and outputting of necessary data with the ROM 74 and the RAM 75.

To the CPU 70, there are connected: a paper sensor 76 for detecting presence and absence of the recording sheet 11; a home position sensor 77 for detecting whether the carriage 29 is at the home position; a temperature sensor 88 for detecting an environmental temperature; a motor driver 78 for driving the carriage motor 14; a motor driver 80 for driving a line feed (LF) motor 79 which rotates the platen roller 12; and an operating panel 81 through which various signals are given to the CPU 70.

A head driver IC 83 operates based on record data 84 outputted from the gate array 73, a transfer clock 85, and a record clock 86, for driving the recording head 20. To the gate array 78, an encoder sensor 87 is connected which measures a moving speed of the carriage 29 and determines recording timing.

[Operation of Wiping Device 50]

Figure 5A:
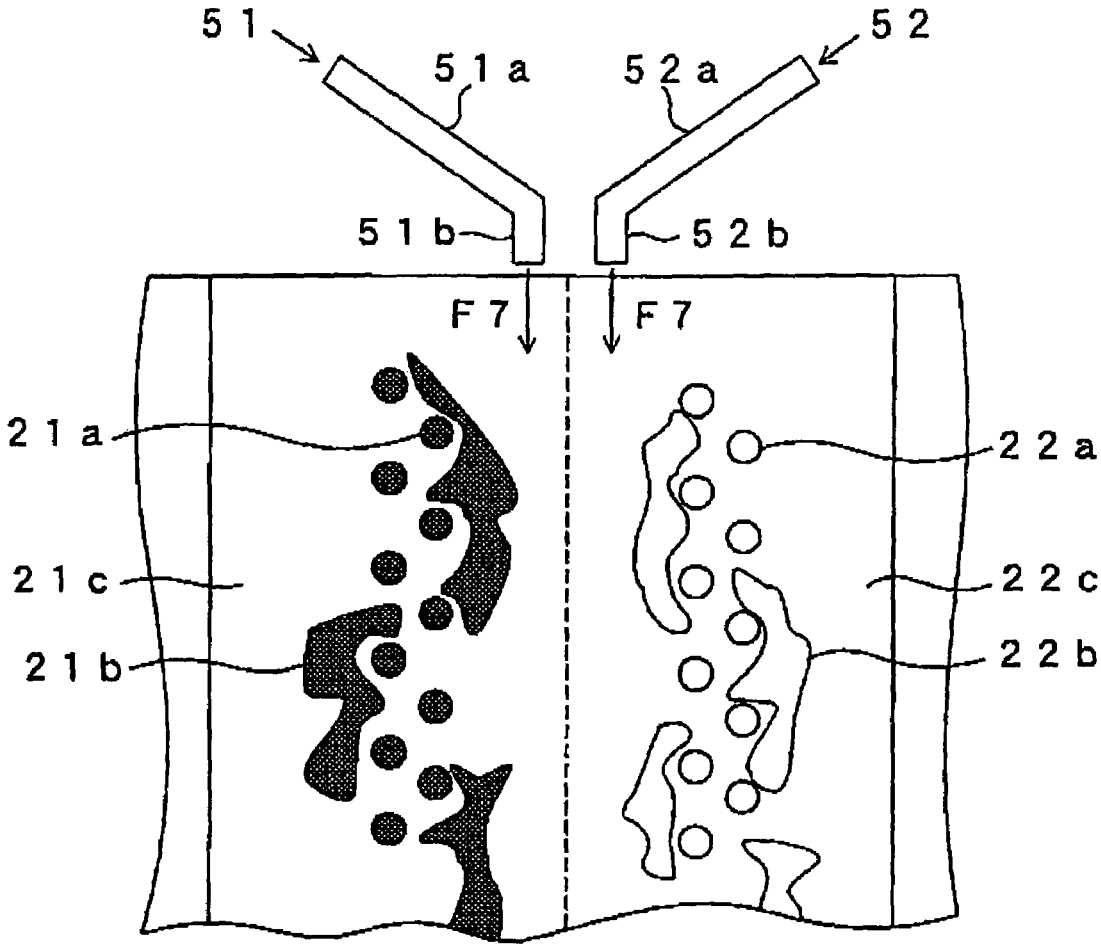
FIG. 5A is a plan view showing a state in which inks adhere to a nozzle surface and FIG. 5B is a front view of the plan view of FIG. 5A.
Figure 5B:
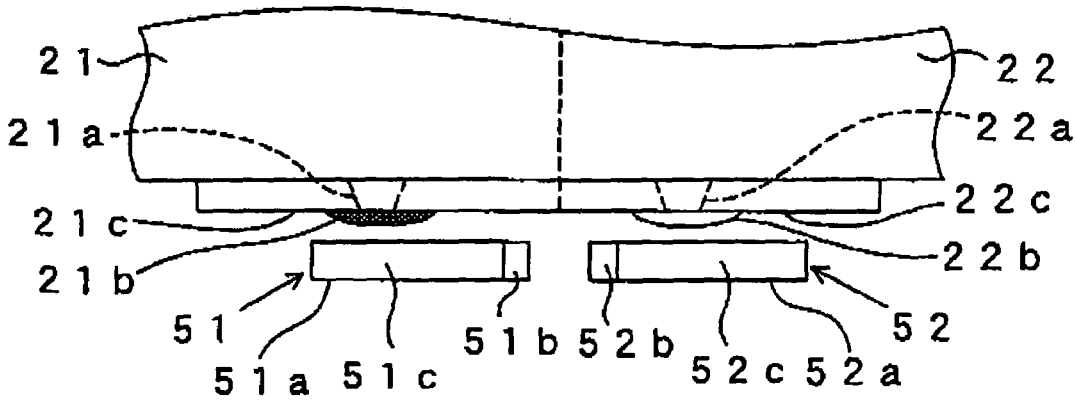
Figure 6A:
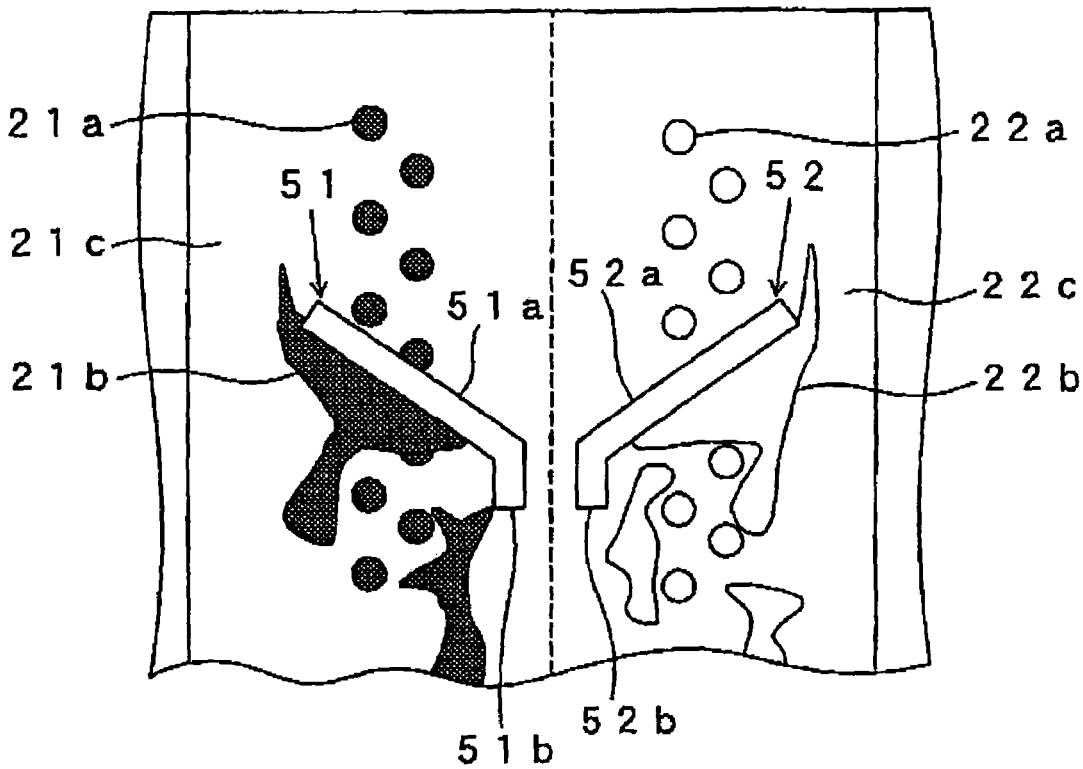
FIG. 6A is a plan view showing a state in which the wiper blades wipe the respective inks and FIG. 6B is a front view of the plan view of FIG. 6A.
Figure 6B:
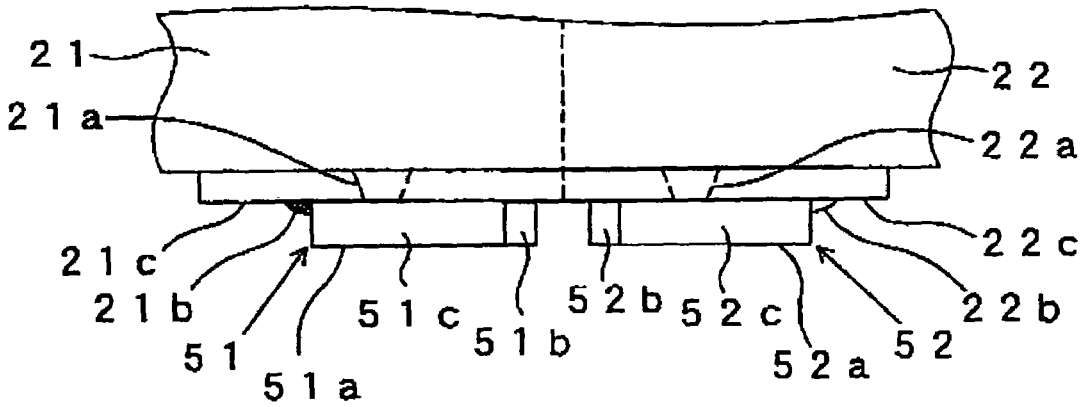

There will be next explained an operation of the wiping device 50. FIG. 5A is a plan view showing a state in which the inks adhere to the nozzle surface before the wiping operation is carried out by the wiper blades 51, 52 and FIG. 5B is a front view of the plan view of FIG. 5A. FIG. 6A is a plan view showing a state in which the wiper blades 51, 52 wipe the inks and FIG. 6B is a front view of the plan view of FIG. 6A.

When the purging operation is carried out, the carriage motor 14 is driven to move the recording head to a predetermined purging position, so that the purging operation is carried out by the purging device 31. After the purging operation has been terminated, the recording head 20 is moved to a predetermined wiping position. Then, the wiping device 50 (shown in FIG. 1 and FIG. 2A) is driven to rotate the rollers 54, 55 in a direction indicated by arrows F8 shown in FIG. 2A. In accordance with the rotation of the rollers 64, 55, the first and second wiper blades 61, 52 fixed to the surface of the endless belt 53 are moved in the direction indicated by the arrow F7, so that the first wiper blade 51 wipes the black ink 21*b* adhering to the nozzle surface 21*c* and the second wiper blade 52 wipes the yellow ink 22*b* adhering to the nozzle surface 22*c*, as shown in FIG. 6A.

During the wiping operation, the black ink 21*b* which has been wiped by the main part 51*a* of the first wiper blade 51 flows in the outward direction away from the boundary area E along the wiping surface 51*c*, that is, flows toward the widthwise opposite end of the nozzle surface 21*c* remote from the boundary area B since the main part 51*a* of the first wiper blade 51 is inclined relative to the line perpendicular to the moving direction, such that the front end of the main part 51*a* is located frontward of the rear end thereof, in the moving direction. Further, since the extension part 51*b* is formed at the front end of the main part 51*a* so as to extend therefrom in the moving direction, the black ink 21*b* which has been wiped by the main part 51*a* is inhibited, with higher reliability, from flowing into and remaining in the boundary area E.

During the wiping operation, the yellow ink 22*b* which has been wiped by the main part 52*a* of the second wiper blade 52 flows in the outward direction away from the boundary area E along the wiping surface 62*c*, that is, flows toward the widthwise opposite end of the nozzle surface 22*c* remote from the boundary area E since the main part 52*a* of the second wiper blade 52 is inclined relative to the line perpendicular to the moving direction, such that the front end of the main part 52*a* is located frontward of the rear end thereof in the moving direction. Further, since the extension part 52*b* is formed at the front end of the main part 52*a* so as to extend therefrom in the moving direction, the yellow ink 22*b* which has been wiped by the main part 52*a* is inhibited, with higher reliability, from flowing into and remaining in the boundary area E.

In the present embodiment, the amount of extension of each extension part 51*b*, 52*b* from the front end of the corresponding main part 51*a*, 52*a* and the angle formed between each main part 51*a*, 52*a* and the moving direction (the angle formed between each main part 51*a*, 52*a* and the corresponding extension part 51*b*, 52*b* in the present embodiment wherein the extension parts 51*b*, 52*b* extend in parallel with the moving direction) are preferably determined based on the relative positional relationship between each wiper blade 51, 52 and the rows of the nozzles of each nozzle group. For instance, the amount of extension of the extension part and the angle described above are preferably determined by taking into account a spacing distance between adjacent nozzles, the width of each nozzle surface, the width of the boundary area E, the length of each nozzle row, the position of each extension part within the boundary area E, etc.

As explained above, when the black ink 21*b* adhering to the nozzle surface 21*c* is wiped by the first wiper blade 51 and the yellow ink 22*b* adhering to the nozzle surface 22*c* is wiped by the second wiper blade 52, the wiped black ink 21*b* and yellow ink 22*b* do not flow into the boundary area E. Accordingly, the present arrangement is effective to prevent mixing of the inks of the different colors, i.e., black and yellow. In the present embodiment, the black ink is the pigment ink and the yellow ink is the dye ink. Accordingly, the present arrangement effectively prevents the aggregation reaction which would be otherwise caused by mixing of the two different kinds of inks with each other.

When the two wiper blades 51, 52 reach one end of the wiping device 60 in the wiping direction near to the roller 56, the wiping operation is terminated. The endless belt 53 is further rotated until the two wiper blades 51, 52 reach a wiping start position where the wiping operation starts. After the endless belt 53 is rotated as described above by a predetermined number of times, it stops such that the two wiper blades 51, 52 are positioned at the wiping start position. In the present embodiment, the endless belt 53 is controlled by the CPU 70 so as to stop when the two wiper blades 51, 52 which have moved from the wiping start position return back to the wiping start position by one rotation of the endless belt 53.

In the recording apparatus 1 equipped with the wiping device 50 having the first and second wiper blades 51, 52 each of which is inclined relative to the line perpendicular to the moving direction, such that one end of each wiper blade 51, 52 located within the boundary area E (i.e., the front end of each wiper blade 51, 52) is located frontward of the other end remote from the boundary area E, in the moving direction, the black ink 21*b* and the yellow ink 22*b* which have been wiped by the respective first and second wiper blades 51, 52 do not flow into the boundary area E beyond the respective front ends. Therefore, the black ink 21*b* and the yellow ink 22*b* wiped by the respective first and second wiper blades 51, 52 do not mix with each other. In the present arrangement, therefore, the mixing of the different colors of inks, i.e., the black ink and the yellow ink can be prevented. Further, where the black ink 21*b* is the pigment ink and the yellow ink 22*b* is the dye ink, the aggregation reaction which would be caused by mixing of the pigment ink and the dye ink does not occur. Accordingly, the recording apparatus 1 is free from various drawbacks that arise from the mixing of the different inks such as the aggregation reaction, assuring high recording quality.

Figure 9:
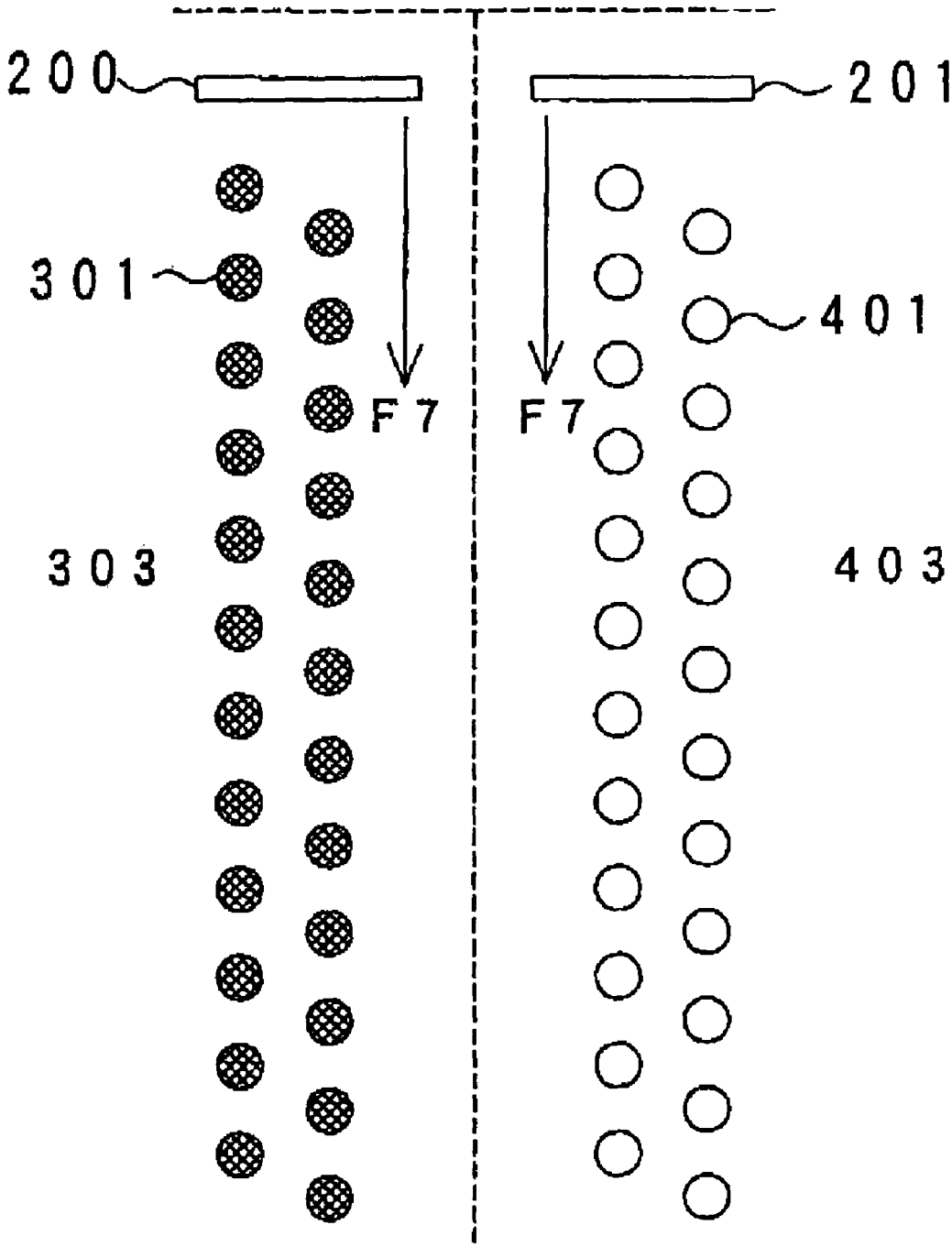
FIG.9 RELATED ART
FIG. 9 is a view showing relative positional relationship between the rows of nozzles of a recording head and wiper blades in a conventional recording apparatus.
Figure 10A:
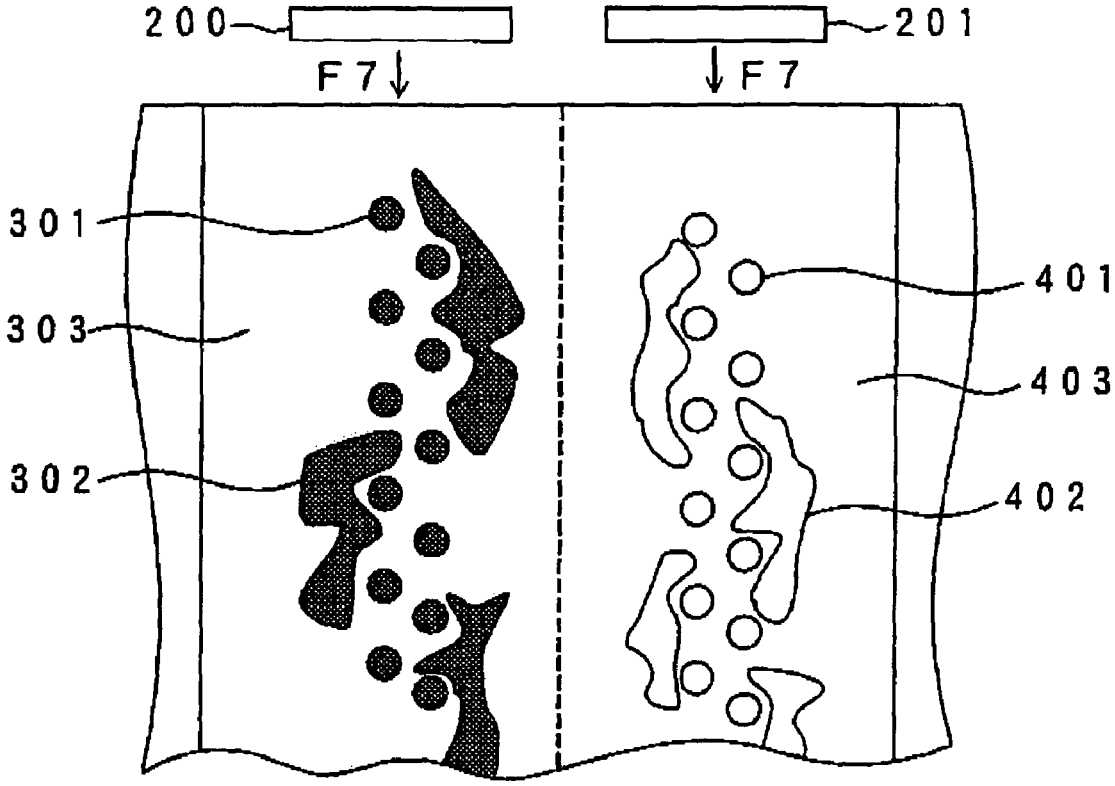
FIG.10A RELATED ART
FIG. 10A is a plan view showing a state in which inks adhere to a nozzle surface in the conventional apparatus of FIG. 9
Figure 10B:
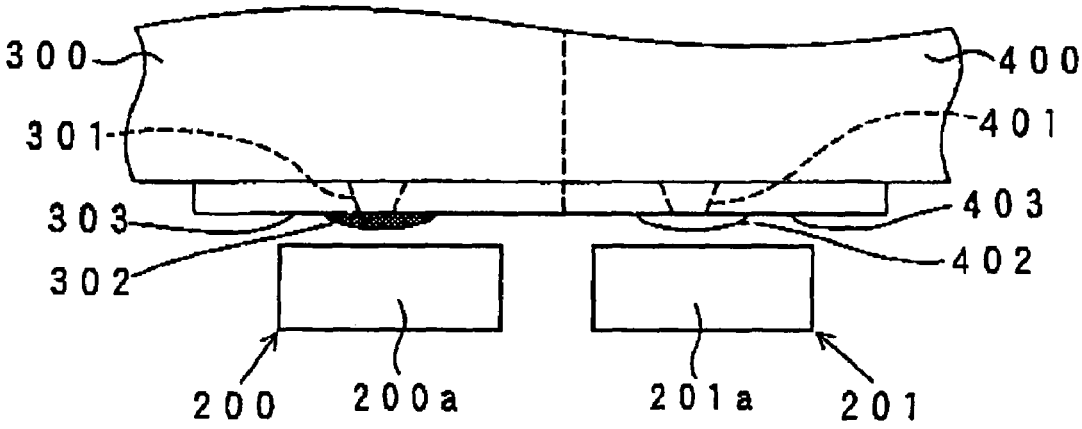
FIG.10B RELATED ART
FIG. 10B is a front view of the plan view of FIG. 10A.
Figure 11A:
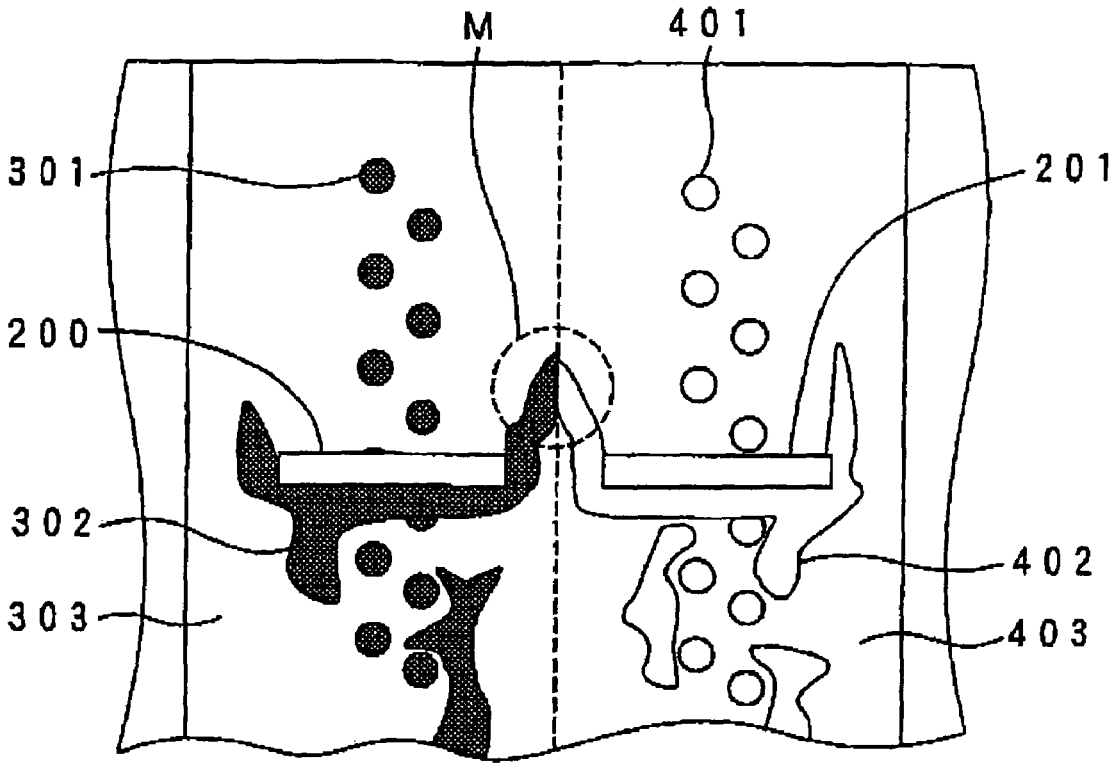
FIG.11A RELATED ART
FIG. 11A is a plan view showing a state in which the wiper blades wipe the respective inks in the conventional apparatus of FIG. 9.
Figure 11B:
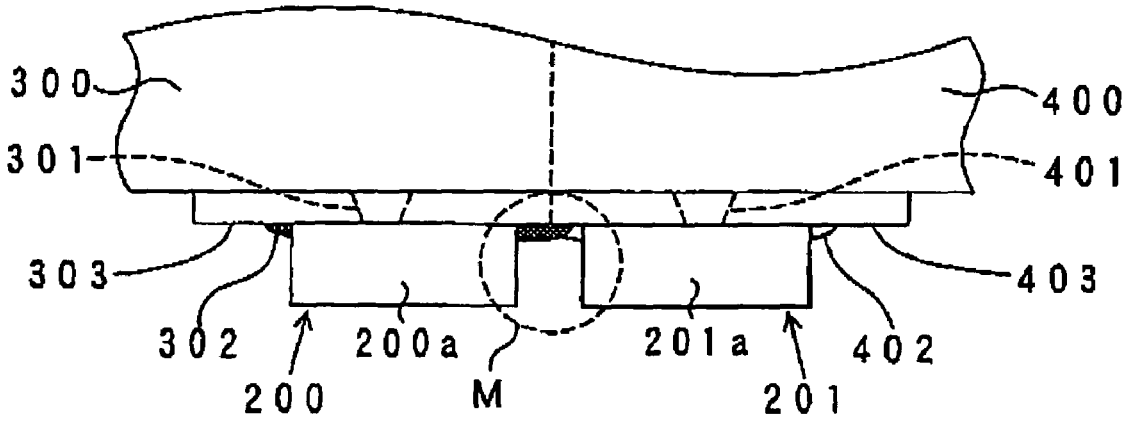
FIG.11B RELATED ART
FIG. 11B is a front view of the plan view of FIG. 11A.
Figure 12:
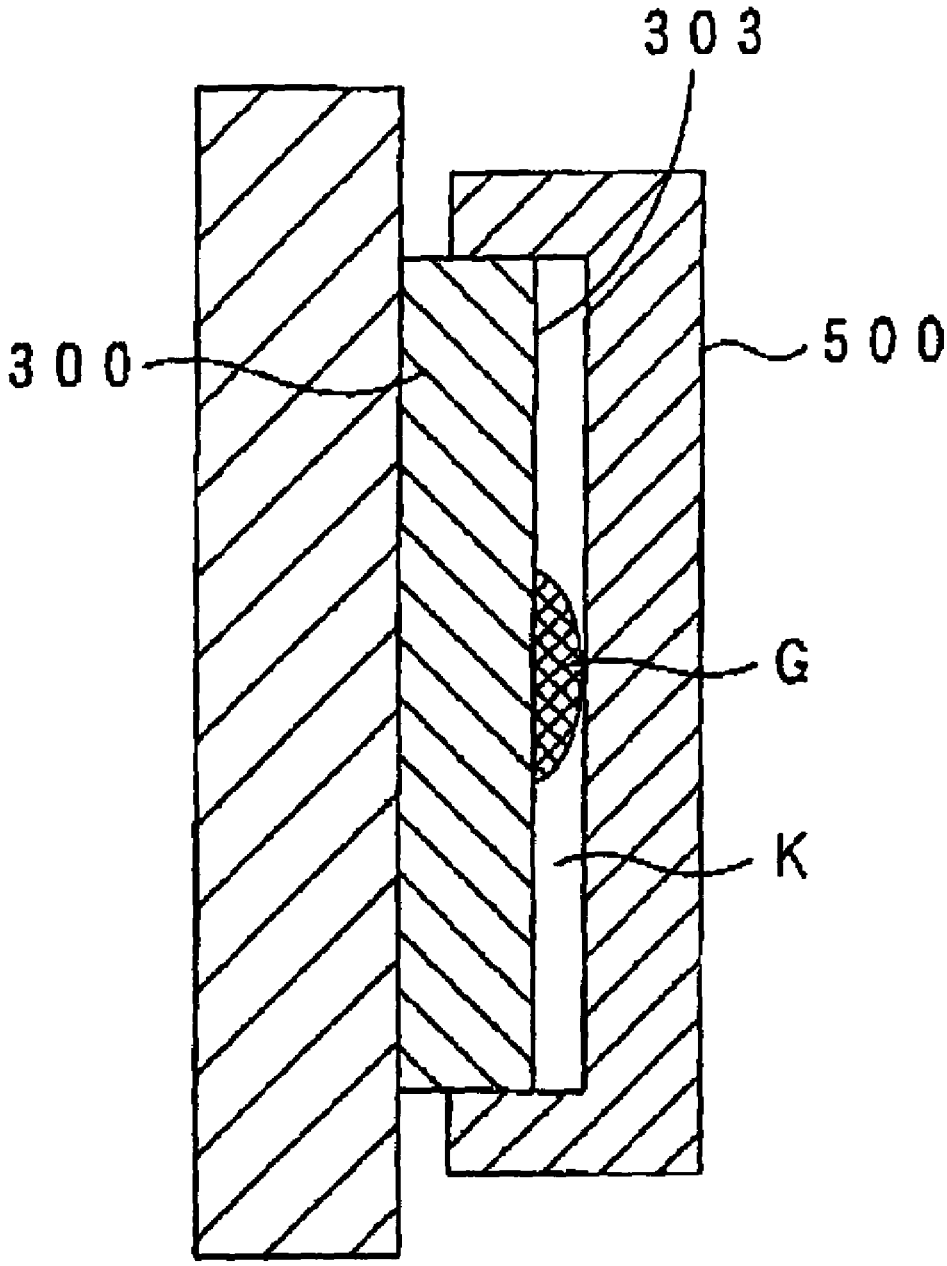
FIG. 12 is a view showing a state in which a clearance is generated between a nozzle surface and a cap due to mixed ink suffering from aggregation reaction.

In the present embodiment, since the first and second wiper blades 51, 52 respectively have the extension parts 51*b*, 52*b* formed at the respective front ends of the main parts 51*a*, 52*a* so as to extend therefrom in the moving direction, even if the black ink 21*b* and the yellow ink 22*b* which have been wiped respectively by the first and second wiper blades 51, 52 are likely to flow into the boundary area E, the flows of the inks 21*b*, 22*b* into the boundary area E are prevented by the respective extension parts 51*b*, 52*b*. Namely, the possibility that the wiped black ink 21*b* and yellow ink 22*b* flow into the boundary area E is lower in a case where the first and second wiper blades 51, 52 have the respective extension parts 51*b*, 52*b* than a case where the first and second wiper blades 51, 52 do not have the extension parts 51*b*, 52*b*. Hence, the wiper blades 51, 52 having the respective extension parts 51*b*, 52*b* are more effective to prevent miring of the wiped black ink 21*b* and yellow ink 22*b* with each other. Further, where the black ink 21*b* is the pigment ink and the yellow ink 22*b* is the dye ink, the aggregation reaction which would be caused by mixing of the pigment ink and the dye ink does not occur. Accordingly, the recording apparatus 1 is fee from various drawbacks which arise from the mixing of the different inks such as the aggregation reaction, so that the recording apparatus 1 assures high recording quality.

Where the two wiper blades 51, 52 are moved in a direction in which the rows of the nozzles 21*a*, 22*a* extend, the distance over which the two wiper blades 51, 52 are moved becomes relatively long and the amount of the ink per unit area to be wiped by each wiping surface 51*c*, 52*c* becomes relatively large. In this case, if the different inks are wiped by the conventional method using the wiper blades shown in FIG. 9, the amount of the inks which flow into and remain in the boundary area E may become large and therefore the amount of the inks which are mixed with each other may become large. Further, where the pigment ink and the dye ink are mixed with each other, the aggregation reaction occurs, and the amount of the mixed ink suffering from the aggregation reaction may become large in the conventional wiping method. In the present recording apparatus 1, however, the risk of flowing of the wiped inks into the boundary area E is low, so that the different inks are not likely to be mixed with each other. Therefore, the present recording apparatus 1 is free from various problems which result from the mixing of the different inks such as the aggregation reaction.

The first and second wiper blades 51, 52 which move along the boundary area E, i.e., which move in a direction in which the boundary area E extends are arranged such that the relative positional relationship between each wiper blade 51, 52 and any of the corresponding nozzles 21*a*, 22*a* in wiping any of the nozzles by the wiper blade is substantially constant. Accordingly, the load which acts on each wiper blade 51, 52 upon wiping the ink is substantially constant irrespective of which nozzles the wiper blade wipes. By arranging the first and second wiper blades 51, 52 so as to be inclined relative to the line perpendicular to the moving direction such that the front ends of the wiper blades 51, 52 are located frontward of the rear ends thereof in the moving direction while corresponding to the relative positional relationship between each wiper blade 51, 52 and the nozzle rows of the corresponding nozzle group 21*g*, 22*g*, it is possible to easily prevent the inks from flowing into the boundary area E irrespective of which nozzles the wiper blade wipes. Therefore, the risk of flowing of the wiped inks into the boundary area E is low.

In the present embodiment wherein the first and second wiper blades 51, 52 are arranged to be inclined relative to the line perpendicular to the moving direction such that the front ends of the wiper blades 51, 52 are located frontward of the rear ends thereof in the moving direction and the nozzles 21*a*, 22*a* of the respective nozzle groups 21*g*, 22*g* are arranged in rows in the moving direction of the two wiper blades 51, 52, at least the front end of each wiper blade 51, 52 does not intersect the nozzle rows. Therefore, the wiped inks are less likely to mix with each other in the areas in which each of the nozzle groups 21*g*, 22*g* is present.

When the yellow ink and the black ink are mixed with each other in a case where the black-ink nozzle group 21*g* and the yellow-ink nozzle group 22*g* are adjacent to each other, the color of the mixed ink is largely influenced by the black ink, so that the quality of the images to be recorded may be deteriorated. In the present recording apparatus 1 constructed as described above, the risk of mixing of the black ink with the yellow ink is low, whereby the recording apparatus 1 does not suffer from the deterioration of the recording quality.

Even where the black ink is the pigment ink and the yellow ink is the dye ink, it is not required in the present embodiment to increase the spacing distance between the black-ink nozzles 21*a* and the yellow-ink nozzles 22*a* for preventing the aggregation reaction which arises from the miring of the two different kinds of inks. Accordingly, the spacing distance between the adjacent nozzle groups can be reduced, leading to a decrease in the size of the recording apparatus 1.

<Second Embodiment>

Figure 7A:
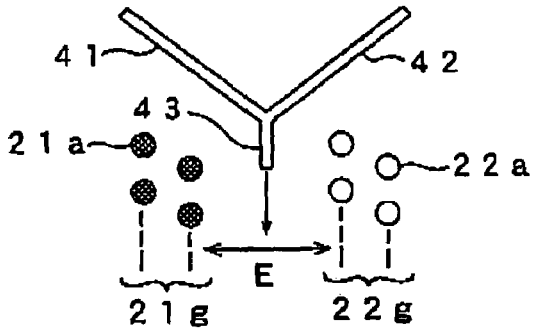
FIGS. 7A–7B are views showing relative positional relationship between wiper blades constructed according to a second embodiment and the rows of nozzles.
Figure 7B:
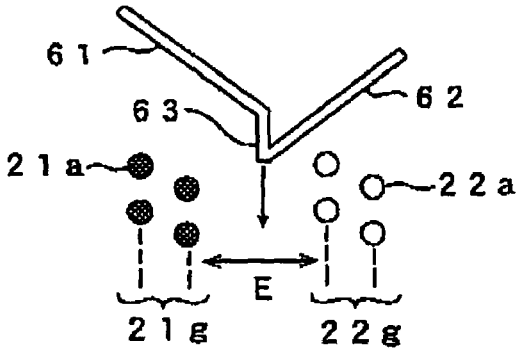

Referring next to FIGS. 7A and 7B, there will be described wiper blades 41, 42 constructed according to a second embodiment of the invention.

In FIG. 7A, the first wiper blade 41 and the second wiper blade 42 have, at respective one ends (front ends) thereof located within the boundary area E, an extension part 43 which is common to the first and second wiper blades 41, 42 and which is located within the boundary area E. From a different viewpoint, it may be considered that the first and second wiper blades 41, 42 respectively have extension parts which are integrated with each other. In the arrangement shown in FIG. 1A, the extension part 43 extends in the moving direction of the two wiper blades 41, 42 from a point of intersection at which main parts of the respective wiper blades 41, 42 intersect in the boundary area E. Although, in the arrangement of FIG. 3, predetermined spacing is present between the two extension parts 51*b*, 52*b*, such spacing is not present in the arrangement of FIG. 7A, thereby contributing to a reduction in the size of the recording apparatus.

In the arrangement of FIG. 3, the area interposed between the two extension parts 51*b*, 52*b* is a non-wipe area that cannot be wiped by the two wiper blades 51, 52. The arrangement of FIG. 7A, however, eliminates such a non-wipe area, so that larger amounts of the inks can be wiped by the wiper blades 41, 42, avoiding various drawbacks such as the aggregation reaction which arise from the mixing of the two different inks. Moreover, since the first and second wiper blades 41, 42 have the common extension part 43, the cost of manufacture of the wiper blades 41, 42 can be reduced, as compared with the arrangement of FIG. 3 in which the first and second wiper blades 51, 52 have the respective extension parts 51, 52*b*.

Another arrangement as shown in FIG. 7B may be employed. In the arrangement of FIG. 7B, a first wiper blade 61 has an extension part 63 whose front end is integrated with a front end of a second wiper blade 62. The recording apparatus equipped with the wiper blades 61, 62 shown in FIG. 7B enjoys the same advantages as those in the recording apparatus equipped with the wiper blades 41, 42 shown in FIG. 7A.

<Third Embodiment>

Figure 7C:
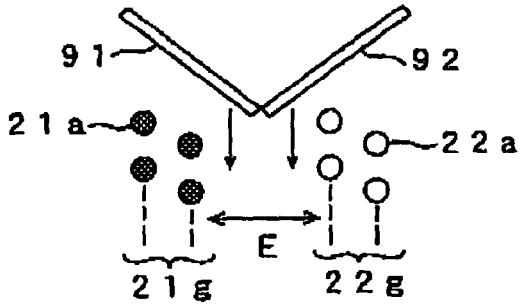
FIGS. 7C–7D are views showing relative positional relationship between wiper blades constructed according to a third embodiment and the rows of nozzles.
Figure 7D:
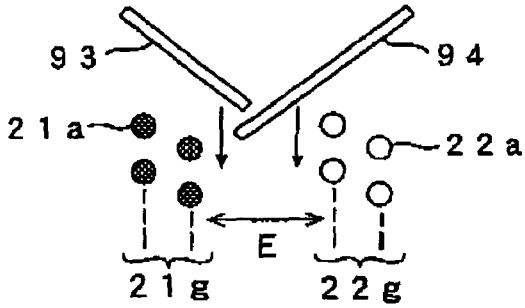

Referring next to FIGS. 7C and 7D, there will be described wiper blades constructed according to a third embodiment of the invention.

In FIG. 7C, a first wiper blade 91 and a second wiper blade 92 are arranged such that the respective front ends thereof are in contact with each other within the boundary area E in the direction perpendicular to the moving direction of the two wiper blades 91, 92. According to the arrangement of FIG. 7C, substantially no wipe-area that cannot be wiped by the wiper blades is formed, unlike in the arrangement of FIG. 3 in which the front ends of the respective wiper blades 51, 52 are spaced apart from each other in that direction. Therefore, larger amounts of the inks can be wiped by the wiper blades 91, 92, avoiding various drawbacks such as the aggregation reaction which would be otherwise caused by the mixing of the different inks.

Another arrangement as shown in FIG. 7D may be employed. In the arrangement of FIG. 7D, a first wiper blade 93 and a second wiper blade 94 are configured such that the respective front ends thereof are spaced apart from each other. In other words, the front end of the first wiper blade 93 is opposed to the surface of the second wiper blade 94 opposite to the wiping surface. In this arrangement, however, the front end of the first wiper blade 93 is located at a position in the direction perpendicular to the moving direction, which position is not nearer to the first nozzle group than a position at which the front end of the second wiper blade 94 is located in the direction. Therefore, the inks which have been wiped by the respective first and second wiper blades 93, 94 do not flow into the boundary area E. The recording apparatus equipped with the thus configured wiper blades 93, 94 enjoys the same advantages as those in the recording apparatus equipped with the wiper blades 91, 92 shown in FIG. 7C. In the arrangement of FIG. 7D, the two wiper blades 93, 94 overlap each other within the boundary area E in the moving direction, whereby the mixing of the inks can be prevented with higher reliability.

<Other Embodiments>

Figure 8A:
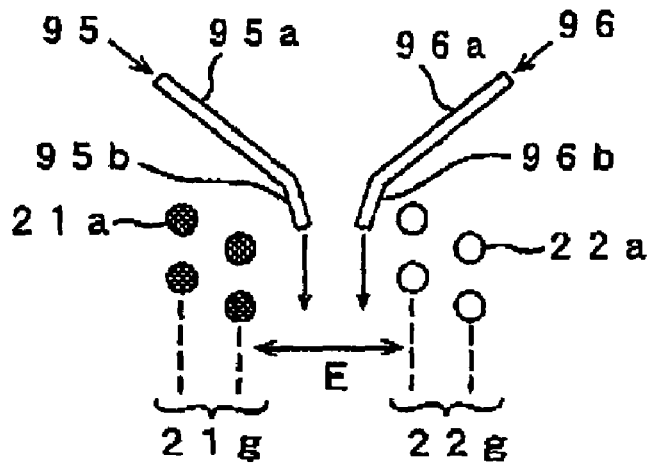
FIGS. 8A–8C are views showing relative positional relationship between wiper blades constructed according to still another embodiments and the rows of nozzles.

The recording apparatus may employ wiper blades 95, 96 as shown in FIG. 8A. In the arrangement of FIG. 8A, the first wiper blade 95 has: a main part 95*a* which obliquely extends such that the front end of the main part 95*a* located within the boundary area E is located frontward of the rear end thereof remote from the boundary area E, in the moving direction of the wiper blades 95, 96; and an extension part 95*b* which extends from the front end of the main part 95*a* in the moving direction. Strictly speaking, the extension part 95*b* extends so as to be inclined with respect to a line parallel to the moving direction. The second wiper blade 96 has: a main part 96*a* which obliquely extends such that the front end of the main part 96*a* located within he boundary area E is located frontward of the rear end thereof remote from the boundary area E, in the moving direction; and an extension part 96*b* which extends from the front end of the main part 96*a* in the moving direction. Strictly speaking, the extension part 96*b* extends so as to be inclined with respect to the line parallel to the moving direction. The recording apparatus equipped with the wiper blades 95, 96 enjoys the same advantages as those in the recording apparatus equipped with the wiper blades 51, 52 according to the first embodiment. The extension part 95*a*, 96*a* which extends so as to be inclined is effective to increase the area that can be wiped by each wiper blade, as compared with the extension part which extends in parallel with the moving direction.

Figure 8B:
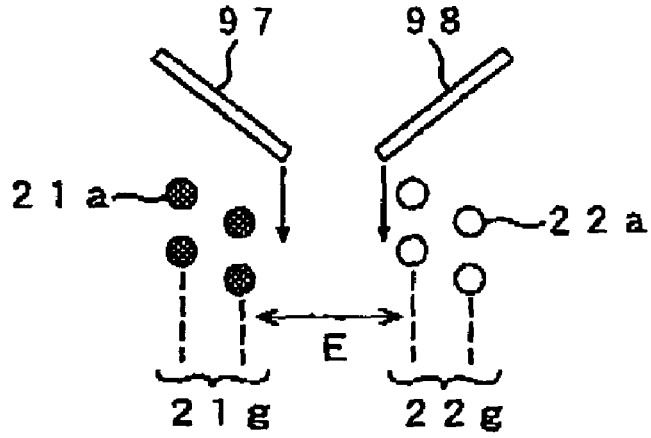

As shown in FIG. 8B, it may be possible to employ wiper blades 97, 98 which do not have the extension part. In a case where large amounts of the inks remain on the respective wiping surfaces, the effect of preventing the flowing of the inks into the boundary area E may be somewhat lower in the arrangement of FIG. 8B than the wiper blades having the extension parts. In the present arrangement, however, the risk of flowing of the inks into the boundary area E is considerably smaller than the conventional arrangement in which the two wiper blades without any extension parts are arranged so as to be perpendicular to the moving direction.

Figure 8C:
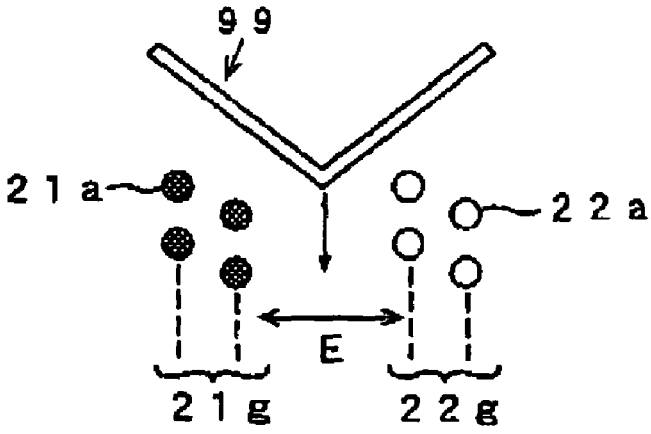

It may be possible to employ a wiper blade 99 shown in FIG. 8C. It may be considered that the wiper blade 99 is constituted by two parts which respectively correspond to the first wiper blade 91 and the second wiper blade 92 of FIG. 7C and whose front ends are connected to each other so as to provide the V-shaped wiper blade 99. Further, it may be considered that the front ends of the two parts are integrated with each other. This arrangement assures substantially the same advantages as those in the arrangement of FIG. 7C. In the arrangement of FIG. 7C, it is needed to produce the two wiper blades 91, 92 and fix, to the endless belt 53, the two wiper blades independently of each other. In the arrangement of FIG. 8C, in contrast, the single wiper blade 99 is produced and fixed to the endless belt 53, whereby the manufacturing process of the recording apparatus is reduced, resulting in a reduction of the manufacturing cost of the apparatus.

In the present invention, the wiper blade is not necessarily inclined relative to the line perpendicular to the moving direction, provided that the wiper blade has the extension part. For instance, it may be possible to employ wiper blades 100, 101 as shown in FIG. 13A and wiper blades 102, 103 as shown in FIG. 13B.

Figure 13A:
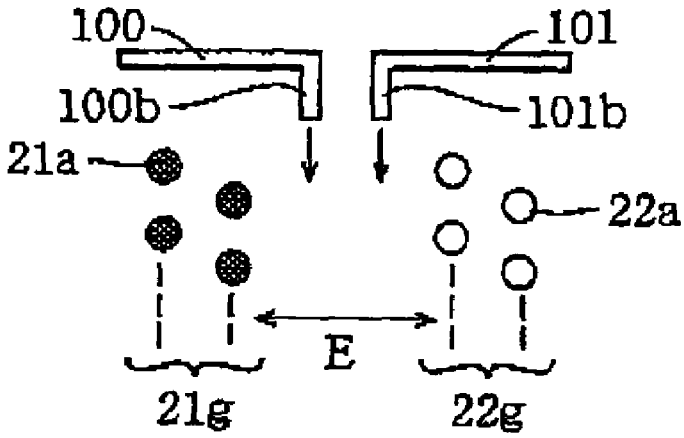
FIGS. 13A and 13B are views showing relative positional relationship between wiper blades constructed according to yet another embodiments and the rows of nozzles.

In FIG. 13A, the main part of each wiper blade 100, 101 is arranged to be perpendicular to the moving direction and the wiper blades 100, 101 have respective extension parts 100*b*, 101*b* which extend in the moving direction. In this arrangement, the flaws of the inks which have been wiped by the respective wiper blades 100, 101 are restricted from flowing into the boundary area E owing to the extension parts 100*b*, 101*b*, so that the mixing of the inks can be prevented. Namely, the wiper blade 100, 101 enjoy the advantages similar to those in the wiper blades 51, 52 of FIG. 3.

Figure 13B:
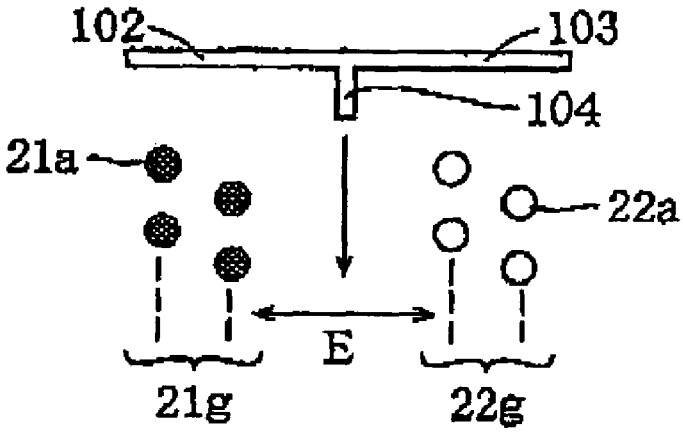

In FIG. 13B, the wiper blades 102, 103 have a common extension part 104 which extends in the moving direction of the wiper blades 102, 103. It may be considered that the first and second wiper blades 102, 103 respectively have the extension parts which are integrated to each other. Although, in the arrangement of FIG. 13A, predetermined spacing is present between the two extension parts 100*b*, 101*b*, such spacing is not present in the arrangement of FIG. 13B, contributing to a reduction in the size of the recording apparatus. Further, in the arrangement of FIG. 13A, the area interposed between the two extension parts 100*b*, 101*b* is a non-wipe area that cannot be wiped by the two wiper blades 100, 101. The arrangement of FIG. 13B can eliminate such a non-wipe area. In addition, since the first and second wiper blades 102, 103 have the common extension part 104, the cost of manufacture of the wiper blades can be reduced.

In the illustrated embodiments, the description was made with respect to the case in which the black-ink nozzle group 21*g* of the black-ink nozzles 21*a* and the yellow-ink nozzle group 22*g* of the yellow-ink nozzles 22*a* are adjacent to each other with the boundary area E interposed therebetween. The principle of the invention may be applicable to a case in which the nozzle group of the black-ink nozzles and a nozzle group of nozzles through which an ink other than the yellow ink is ejected is adjacent to each other. In essence, the color of the ink ejected from each of the adjacent nozzle groups is not particularly limited and the kind of the ink ejected from each of the adjacent nozzle groups is not limited to the pigment ink and the dye ink, as long as the mixing of the inks which are respectively ejected from the adjacent nozzle groups is expected to cause undesirable problems such as the aggregation reaction upon mixing with each other.

Figure 7E:
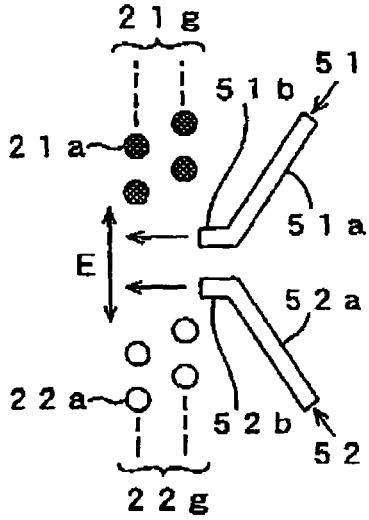
FIG. 7E is a view sowing relative positional relationship between wiper blades constructed according to another embodiment and the rows of nozzles.

In the illustrated embodiments, the wiper blades are arranged to move in the direction parallel to the nozzle rows. The principle of the invention may be applicable to a case shown in FIG. 7E in which the two nozzle groups 21*g*, 22*g* are arranged adjacent to each other in a direction parallel to the respective nozzle rows with the boundary area E interposed therebetween. In this case, the wiper blades 51, 52 are moved such that the respective extension parts 51*a*, 52*a* of the first and second wiper blades 51, 52 move within the boundary area E in a direction perpendicular to the nozzle rows of the respective nozzle groups 21*g*, 22*g*. This arrangement enjoys the same advantages as those described with respect to the illustrated first embodiment.

Where the nozzle rows are arranged as shown in FIG. 7E, it may be possible to use the wiper blades 41, 42; 61, 62 in the illustrated second embodiment, the wiper blades 91, 92; 93, 94 in the illustrated third embodiment, or the wiper blades of the other arrangements described above. In any case, the advantages similar to those in the second embodiment, the third embodiment, or the above-described other arrangements are assured.

The illustrated embodiments employ, as means for moving the wiper blades, the structure in which the endless belt is stretched between the rollers and the wiper blades are fixed to the surface of the endless belt. The means may be otherwise constituted. For instance, the wiper blades may be fixed to a surface of a plate member and the plate member may be reciprocated to move the wiper blades.

In a path on which the wiper blades which have performed the wiping operation pass, there may be provided means for wiping the inks adhering to the wiper blades. In this arrangement, the inks which have adhered to the wiper blades during the wiping operation can be automatically wiped. The means may be constituted, for instance, by suitable members which exhibit excellent ink absorbing property, such as those formed of a non-woven fabric, a porous material. For instance, in FIG. 2A, the means may be provided in the path on which the wiper blades 51, 52 which have performed the wiping operation pass.

The length L1 of the main part of the wiper blade, the angle θ formed by the main part and the moving direction of the wiper blade, and the angle formed by the main part and the extension part in the illustrated embodiments may be determined depending upon the spacing distance between adjacent nozzles as viewed in the direction perpendicular to the moving direction, the width of each nozzle surface, the spacing distance between the adjacent nozzle groups, etc. The height H1 (FIG. 2C) of the main part and the extension part of the wiper blade in the illustrated embodiments are preferably determined to be a level that prevents the ink remaining on the wiping surface from overflowing the wiping surface, so as to inhibit the wiped ink from adhering back to the nozzle surface. Further, the height H1 and the length D1 (FIG. 2B) of the extension part are preferably determined to be respective suitable values that prevent the ink remaining on the wiping surface from flowing into the boundary area E beyond the extension part.

In the illustrated embodiments, the main part of the wiper blade is a straight member. The main part may be configured such that the wiping surface is concaved in the backward direction. For instance, the wiper blade may have an arcuate shape. The thus configured wiper blade can hold, in the concave portion, a larger amount of ink than the straight wiper blade, and accordingly the height of the concave wiper blade can be made lower than that of the straight wiper blade.

It is to be understood that the present invention may be embodied with various changes and modifications, which may occur to those skilled in the art, without departing from the spirit and scope of the invention.

What is claimed is:

1. A recording apparatus which performs recording by ejecting ink toward a recording medium, the apparatus comprising:

a first nozzle group and a second nozzle group which are formed in a nozzle surface so as to be adjacent to each other with a boundary area interposed therebetween, from which are respectively ejected a first ink and a second ink, and each of which consists of a plurality of nozzles; and, a wiping device including a first wiping member and a second wiping member which move along the boundary area while being held in abutting contact with the nozzle surface so as to respectively wipe the first ink and the second ink adhering to the nozzle surface, wherein each of the first wiping member and the second wiping member is inclined relative to a line perpendicular to a moving direction in which the first and second wiping members move, such that one end of each of the first and the second wiping members located within the boundary area is located frontward of the other end thereof remote from the boundary area, in the moving direction.

2. The recording apparatus according to claim 1, wherein each of the first and the second wiping members is linearly inclined relative to the line.

3. The recording apparatus according to claim 1, wherein an angle formed by and between each of the first and the second wiping members and the moving direction is in a range of 130°–140°.

4. The recording apparatus according to claim 1, wherein the one end of the first wiping member is located at a position in a direction perpendicular to the moving direction, which position is not nearer to the first nozzle group than a position at which the one end of the second wiping member is located in the direction.

5. The recording apparatus according to claim 1, wherein the one end of the first wiping member and the one end of the second wiping member are in contact with each other.

6. The recording apparatus according to claim 1, wherein the one end of the first wiping member and the one end of the second wiping member are integrated with each other.

7. The recording apparatus according to claim 1, wherein at least one of the first wiping member and the second wiping member has, at the one end thereof located within the boundary area, an extension part which extends in the moving direction.

8. The recording apparatus according to claim 7, wherein the first wiping member and the second wiping member respectively have the extension parts.

9. The recording apparatus according to claim 8, wherein the extension parts of the respective first and second wiping members are integrated with each other.

10. The recording apparatus according to claim 1, wherein the first wiping member and the second wiping member have, at the respective one ends thereof located within the boundary area, an extension part which is common to the first wiping member and the second wiping member.

11. The recording apparatus according to claim 1, wherein the plurality of nozzles of each of the first nozzle group and the second nozzle group are arranged in the moving direction.

12. The recording apparatus according to claim 1, wherein the first ink ejected from the first nozzle group and the second ink ejected from the second nozzle group cause aggregation reaction upon mixing with each other.

13. The recording apparatus according to claim 1, wherein the first ink ejected from the first nozzle group is a pigment ink and the second ink ejected from the second nozzle group is a dye ink.

14. The recording apparatus according to claim 1, wherein the first ink ejected from the first nozzle group is a black ink and the second ink ejected from the second nozzle group is an ink other than the black ink.

15. The recording apparatus according to claim 14, wherein the second ink ejected from the second nozzle group is a yellow ink.

16. The recording apparatus according to claim 1, wherein the first wiping member is arranged to move in the moving direction so as to pass all of the plurality of nozzles of the first nozzle group while the second wiping member is arranged to move in the moving direction so as to pass all of the plurality o£ nozzles of the second nozzle group.

17. The recording apparatus according to claim 16, wherein the first ink which has been wiped by the first wiping member and the second ink which has been wiped by the second wiping member respectively flow in widthwise opposite directions of the nozzle surface away from the boundary area beyond the other ends of the respective first and second wiping members remote from the boundary area.

18. The recording apparatus according to claim 1, comprising a plurality of nozzles arranged in a plurality of rows that are parallel to one another, wherein the boundary area is formed between any two of the plurality of rows, and the nozzles located on one of opposite sides of the boundary area constitute the first nozzle group while the nozzles located on the other of the opposite sides of the boundary area constitute the second nozzle group.

19. The recording apparatus according to claim 1, wherein the plurality of nozzles of the first nozzle group are arranged in at least one row and the plurality of nozzles of the second nozzle group are arranged in at least one row, and the at least one row of the first nozzle group and the at least one row of the second nozzle group extend in parallel to each other, and wherein the first wiping member and the second wiping member move in a direction of extension of the at least one row of the first nozzle group and the at least one row of the second nozzle group.

20. A recording apparatus which performs recording by ejecting ink toward a recording medium, the apparatus comprising:

a first nozzle group and a second nozzle group which are formed in a nozzle surface so as to be adjacent to each other with a boundary area interposed therebetween, from which are respectively ejected a first ink and a second ink, and each of which consists of a plurality of nozzles; and, a wiping device including a first wiping member and a second wiping member which move along the boundary area while being held in abutting contact with the nozzle surface so as to respectively wipe the first ink and the second ink adhering to the nozzle surface, wherein at least one of the first wiping member and the second wiping member has an extension part which is formed at one end thereof located within the boundary area and which extends in a moving direction in which the first and second wiping members move.

21. The recording apparatus according to claim 20, wherein the first wiping member and the second wiping member respectively have the extension parts.

22. The recording apparatus according to claim 21, wherein the extension parts of the respective first and second wiping members are integrated with each other.

23. The recording apparatus according to claim 20, wherein the first wiping member and the second wiping member have, at the respective one ends thereof located within the boundary area, the extension part which is common to the first wiping member and the second wiping member.

24. The recording apparatus according to claim 20, wherein the plurality of nozzles of each of the first nozzle group and the second nozzle group are arranged in the moving direction.

25. The recording apparatus according to claim 20 wherein the first ink ejected from the first nozzle group and the second ink ejected from the second nozzle group cause aggregation reaction upon mixing with each other.

26. The recording apparatus according to claim 20 wherein the first ink ejected from the first nozzle group is a pigment ink and the second ink ejected from the second nozzle group is a dye ink.

27. The recording apparatus according to claim 20, wherein the first ink ejected from the first nozzle group is a black ink and the second ink ejected from the second nozzle group is an ink other than the black ink.

28. The recording apparatus according to claim 27, wherein the second ink ejected from the second nozzle group is a yellow ink.

29. The recording apparatus according to claim 20, wherein the first wiping member is arranged to move in the moving direction so as to pass all of the plurality of nozzles of the first nozzle group while the second wiping member is arranged to move in the moving direction so as to pass all of the plurality of nozzles of the second nozzle group.

30. The recording apparatus according to claim 29, wherein the first ink which has been wiped by the first wiping member and the second ink which has been wiped by the second wiping member respectively flow in widthwise opposite directions of the nozzle surface away from the boundary area beyond the other ends of the respective first and second wiping members remote from the boundary area.

31. The recording apparatus according to claim 20, comprising a plurality of nozzles arranged in a plurality of rows that are parallel to one another, wherein the boundary area is formed between any two o£ the plurality of rows and the nozzles located on one of opposite sides of the boundary area constitute the first nozzle group while the nozzles located o the other of the opposite sides of the boundary area constitutes the second nozzle group.

32. The recording apparatus according to claim 20, wherein the plurality of nozzles of the first nozzle group are arranged in at least one row and the plurality of nozzles of the second nozzle group are arranged in at least one row, and the at least one row of the first nozzle group and the at least one row of the second nozzle group extend in parallel to each other, and wherein the first wiping member and the second wiping member move in a direction, of extension o£ the at least one row of the first nozzle group and the at least one row of the second nozzle group.

33. A recording apparatus which performs recording by ejecting ink toward a recording medium, the apparatus comprising:

a first nozzle group and a second nozzle group which are formed in a nozzle surface so as to be adjacent to each other with a boundary area interposed therebetween, from which are respectively ejected a first ink and a second ink, and each of which consists of a plurality of nozzles; and, a wiping device including a first wiping member and a second wiping member which move along the boundary area while being held in abutting contact with the nozzle surface so as to respectively wipe the first ink and the second ink adhering to the nozzle surface, wherein the wiping device further includes ink-flow restricting means for restricting a flow of the first ink which has been wiped by the first wiping member and a flow of the second ink which has been wiped by the second wiping member, such that the flow of the first ink does not flow toward the second nozzle group beyond one end of the first wiping member located within the boundary area and the flow of the second ink does not flow toward the first nozzle group beyond one end of the second wiping member located within the boundary area.

34. The recording apparatus according to claim 33, wherein the ink-flow restricting means comprises that each of the first wiping member and the second wiping member is configured so as to be inclined relative to a line perpendicular to a moving direction in which the first and second wiping members move, such that one end of each of the first wiping member and the second wiping member located within the boundary area is located frontward of the other end thereof remote from the boundary area, in the moving direction.

35. The recording apparatus according to claim 33, wherein the ink-flow restricting means comprises that at least one of the first wiping member and the second wiping member is configured so as to have an extension part which is formed at one end thereof located within the boundary area and which extends in a moving direction in which the first and second wiping members move.

36. The recording apparatus according to claim 33, wherein the first wiping member is arranged to move in the moving direction so as to pass all of the plurality of nozzles of the first nozzle group while the second wiping member is arranged to move in the moving direction so as to pass all of the plurality of nozzles of the second nozzle group.

37. The recording apparatus according to claim 36, wherein the first ink which has been wiped by the first wiping member and the second ink which has been wiped by the second wiping member respectively flow in widthwise opposite directions of the nozzle surface away from the boundary area beyond the other ends of the respective first and second wiping members remote from the boundary area.

38. The recording apparatus according to claim 33, comprising a plurality of nozzles arranged in a plurality of rows that are parallel to one another, wherein the boundary area is formed between any two of the plurality of rows and the nozzles located on one of opposite sides of the boundary area constitute the first nozzle group while the nozzles located o the other of the opposite sides of the boundary area constitutes the second nozzle group.

39. The recording apparatus according to claim 33, wherein the plurality of nozzles of the first nozzle group are arranged in at least one row and the plurality of nozzles of the second nozzle group are arranged in at least one row, and the at least one row of the first nozzle group and the at least one row of the second nozzle group extend in parallel to each other, and wherein the first wiping member and the second wiping member move in a direction of extension of the at least one row of the first nozzle group and the at least one row of the second nozzle group.

* * * * *